US008011767B2

(12) United States Patent
Sugiyama et al.

(10) Patent No.: US 8,011,767 B2
(45) Date of Patent: Sep. 6, 2011

(54) INK CARTRIDGE LOADABLE INTO CHAMBER OF CASING BY GUIDE MEMBER

(75) Inventors: Wataru Sugiyama, Aichi-ken (JP); Noritsugu Ito, Tokoname (JP); Naokazu Tanahashi, Nagoya (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 669 days.

(21) Appl. No.: 11/559,063

(22) Filed: Nov. 13, 2006

(65) Prior Publication Data

US 2007/0120901 A1 May 31, 2007

(30) Foreign Application Priority Data

Nov. 30, 2005 (JP) ..... 2005-345866

(51) Int. Cl.
*B41J 2/175* (2006.01)

(52) U.S. Cl. ..... 347/86; 347/85

(58) Field of Classification Search ..... 347/7, 49, 347/86, 87, 85
See application file for complete search history.

(56) References Cited

U.S. PATENT DOCUMENTS 5,479,193 A * 12/1995 Shimoda et al. ..... 347/7
5,534,899 A * 7/1996 Uchikata et al. ..... 347/49
5,971,534 A * 10/1999 Sasaki et al. ..... 347/86
6,170,940 B1 * 1/2001 Shinada et al. ..... 347/86
6,250,750 B1 * 6/2001 Miyazawa et al. ..... 347/87
6,296,345 B1 10/2001 Kline et al.
6,435,662 B2 8/2002 Kline et al.
6,471,334 B2 10/2002 Kline et al.
6,502,917 B1 1/2003 Shinada et al.
6,817,699 B2 11/2004 Hirashima et al.
6,948,798 B2 9/2005 Kline et al.
2004/0135857 A1 7/2004 Hashii
2004/0263569 A1 * 12/2004 Ros et al. ..... 347/49
2005/0052511 A1 3/2005 Seino et al.

(Continued)

FOREIGN PATENT DOCUMENTS

EP 0478244 A2 4/1992

(Continued)

OTHER PUBLICATIONS

European Patent Office, European Search Report for Related EP Application No. 06023365 dated Mar. 14, 2008.

(Continued)

*Primary Examiner* — Stephen D Meier
*Assistant Examiner* — Carlos A Martinez, Jr.
(74) *Attorney, Agent, or Firm* — Baker Botts L.L.P.

(57) ABSTRACT

An ink cartridge loading device has: a casing, a door, and a guiding member. The casing has a chamber that accommodates an ink cartridge, and an opening communicated with the chamber for loading and unloading the ink cartridge therethrough. The door is provided at the casing and is movable between a first position and a second position. The door closes the opening at the first position. The door opens the opening at the second position. The guiding member is provided on the door and partially guides the ink cartridge from the chamber through the opening to outside when the door moves from the first position to the second position. The guiding member supports the ink cartridge together with the door when the door is at the second position. The guiding member guides the ink cartridge into the chamber when the door is closing.

10 Claims, 16 Drawing Sheets

U.S. PATENT DOCUMENTS

| | | | |
|---|---|---|---|
| 2005/0162494 | A1 | 7/2005 | Inokuchi et al. |
| 2005/0168545 | A1 | 8/2005 | Sakai et al. |
| 2005/0185036 | A1 | 8/2005 | Seino et al. |

FOREIGN PATENT DOCUMENTS

| | | | |
|---|---|---|---|
| EP | 0626267 | A2 | 11/1994 |
| JP | H6 106730 | | 4/1994 |
| JP | H10 109427 | | 4/1998 |
| JP | H11 348303 | | 12/1999 |
| JP | 2001 113722 | | 4/2001 |
| JP | 2002 211077 | | 7/2002 |
| JP | 2002 254670 | | 9/2002 |
| JP | 2003 519028 | | 6/2003 |
| JP | 2004 345246 | | 12/2004 |
| JP | 2005 96446 | | 4/2005 |
| JP | 2005 219416 | | 8/2005 |
| WO | 9855322 | A1 | 12/1998 |

OTHER PUBLICATIONS

European Patent Office; Communication pursuant to Article 94(3) EPC in European Patent Application No. 06 023 365.7 (counterpart to the above-captioned U.S. patent application) mailed Jan. 11, 2010.

* cited by examiner

INK CARTRIDGE LOADABLE INTO CHAMBER OF CASING BY GUIDE MEMBER

CROSS REFERENCE TO RELATED APPLICATIONS

This application claims priority from Japanese Patent Application No. 2005-345866 filed Nov. 30, 2006. The entire content of each of these priority applications is incorporated herein by reference.

TECHNICAL FIELD

This invention relates to an ink cartridge loading device installed in an inkjet recording device.

BACKGROUND

An inkjet recording device records an image on a sheet of recording paper by ejecting ink droplets from a recording head thereon. Ink is generally contained in an ink tank provided in an ink cartridge, and supplied from the ink cartridge to the recording head. Therefore, when the remaining amount of the ink in the ink cartridge is reduced, the ink cartridge needs to be replaced by a new one. Japanese Patent Publications hei 11-348303, hei 10-109427, 2004-345246, 2005-219416, and 2005-96446 disclose an inkjet recording device having a replaceable ink cartridge. Generally, the ink cartridge is loaded and fixed to a predetermined position in the casing provided in the inkjet recording device.

There are two types of ink cartridges: an on-carriage type and an off-carriage type, according to an arrangement of the ink cartridge in a casing of the inkjet recording device. The on-carriage type is an ink cartridge mounted on a carriage having a recording head which reciprocates in a direction perpendicular to the sheet conveying direction. In other words, a casing of the ink cartridge is attached to the carriage, and ink is supplied from the ink cartridge to the recording head in the carriage.

On the other had, the off-carriage type is an ink cartridge mounted in an other area except the carriage in the inkjet recording device. In this case, the ink cartridge and the casing are assembled as one unit, and the unit is then installed in the inkjet recording device. Therefore, ink is supplied from an ink tank in the ink cartridge to the recording head through an ink-supply tube. Such a kind of ink cartridge is generally referred to as "a refill unit".

The casing of the refill unit is generally provided with a door. The door is closed when the ink cartridge is in the casing, so that the ink cartridge is reliably accommodated and held in the casing. An ink supply needle is provided in the casing, and the ink supply needle is inserted into the ink cartridge when the ink cartridge is in the casing. The ink in the ink cartridge is fed to the recording head through the ink supply needle and the ink supply tube. Japanese Patent Publication hei 6-106730 discloses an inkjet recording device having a door for loading and unloading the ink cartridge from the casing. In this device, the door is open when the ink cartridge is replaced.

It is preferable that the operation of replacing the ink cartridge is performed by a user of the inkjet recording device easily and quickly. In other words, there is a demand that the used ink cartridge should be easily unloaded from the casing and a new ink cartridge should be easily loaded into the casing.

SUMMARY

In view of the foregoing, it is an object of the invention to provide an ink cartridge loading device in which an ink cartridge is easily and readily replaceable.

The invention provides an ink cartridge loading device, having: a casing, a door, and a guiding member. The casing has a chamber that accommodates an ink cartridge, and an opening communicated with the chamber for loading and unloading the ink cartridge therethrough. The door is provided at the casing. The door is movable between a first position and a second position. The door closes the opening at the first position. The door opens the opening at the second position. The guiding member is provided on the door. The guiding member partially guides the ink cartridge from the chamber through the opening to outside when the door moves from the first position to the second position. The guiding member supports the ink cartridge together with the door when the door is at the second position. The guiding member guides the ink cartridge into the chamber when the door moves from the second position to the first position.

The invention provides an ink cartridge unit having an ink cartridge, and an ink cartridge loading device that accommodates the ink cartridge therein. The ink cartridge loading device has: a casing, a door, and a guiding member. The casing has a chamber that accommodates an ink cartridge, and an opening communicated with the chamber for loading and unloading the ink cartridge therethrough. The door is provided at the casing. The door is movable between a first position and a second position. The door closes the opening at the first position. The door opens the opening at the second position. The guiding member is provided on the door. The guiding member partially guides the ink cartridge from the chamber through the opening to outside when the door moves from the first position to the second position. The guiding member supports the ink cartridge together with the door when the door is at the second position. The guiding member guides the ink cartridge into the chamber when the door moves from the second position to the first position.

The invention provides an ink cartridge loadable in an ink cartridge loading device. The ink cartridge loading device has: a casing, a door, and a guiding member. The casing has a chamber that accommodates an ink cartridge, and an opening communicated with the chamber for loading and unloading the ink cartridge therethrough. The door is provided at the casing. The door is movable between a first position and a second position. The door closes the opening at the first position. The door opens the opening at the second position. The guiding member is provided on the door. The guiding member partially guides the ink cartridge from the chamber through the opening to outside when the door moves from the first position to the second position. The guiding member supports the ink cartridge together with the door when the door is at the second position. The guiding member guides the ink cartridge into the chamber when the door moves from the second position to the first position. The ink cartridge has a main unit that contains ink. The main unit has an engaging portion that receives the guiding member when the door is at the second position.

BRIEF DESCRIPTION OF THE DRAWINGS

Illustrative aspects in accordance with the invention will be described in detail with reference to the following figures wherein.

DETAILED DESCRIPTION

Figure 1:
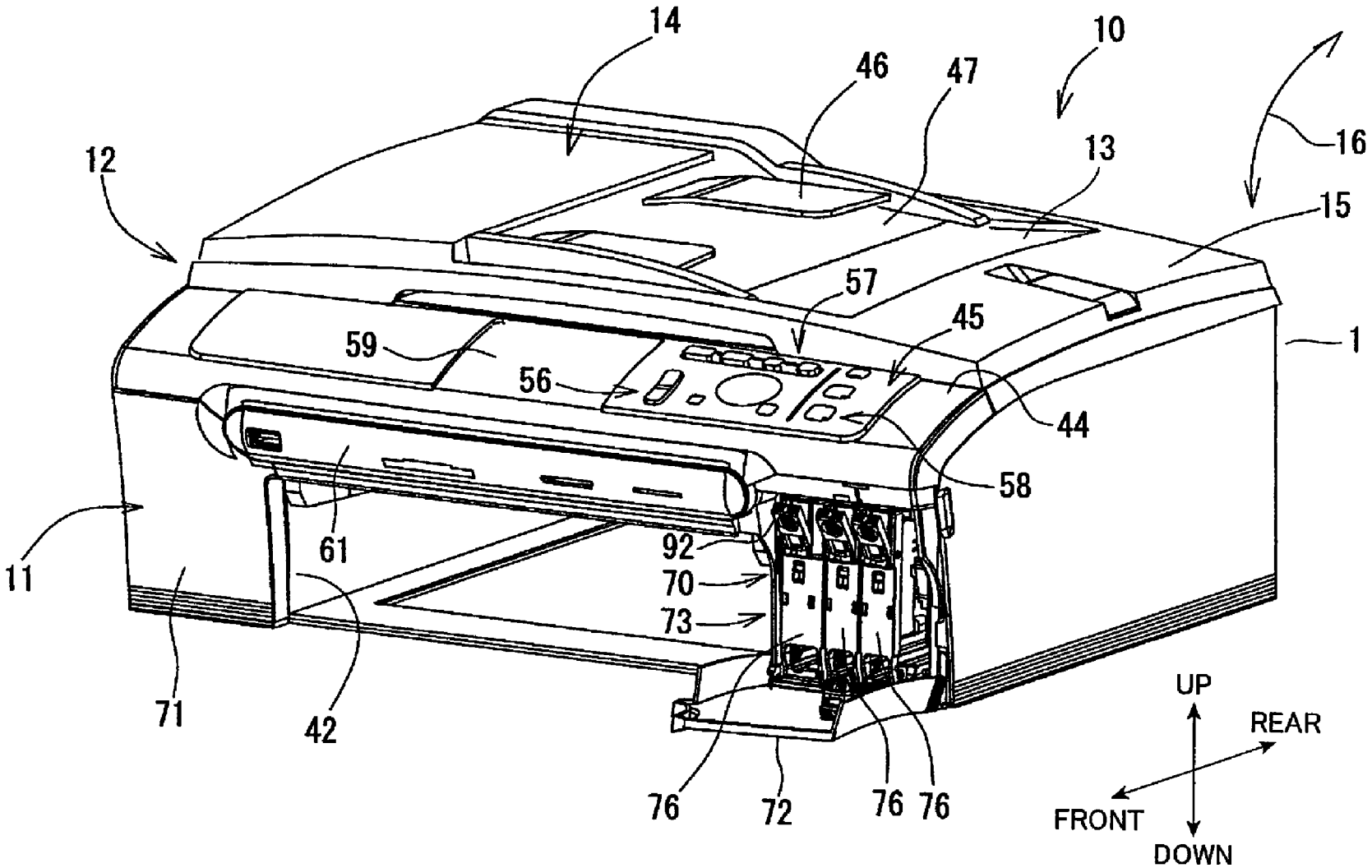
FIG. 1 is a perspective view showing a multifunction device according to an illustrative aspect of the invention.

An inkjet cartridge loading device according to some aspects of the invention will be described while referring to the accompanying drawings wherein like parts and components are designated by the same reference numerals to avoid duplicating description. The expressions "front", "rear", "above", "below", "right", and "left" are used throughout the description to define the various parts when the inkjet cartridge loading device and a multifunction device including the same is disposed in an orientation in which it is intended to be used.

Referring to FIG. 1, a multifunction device 10 having a refill unit as the ink cartridge loading device of the invention has a printer section 11 at a lower part of a housing 1 and a scanner section 12 at an upper part of the housing 1. The multifunction device 10 has various functions such as a printer, a scanner, a copying machine, and a facsimile machine. The multifunction device 10 is connectable to a computer (not shown) and configured to record image and a document on a sheet of recording paper according to the image data and the document data transmitted from the computer. Additionally, the multifunction device 10 is connectable to other devices such as a digital camera. The multifunction device 10 has a slot section 61. When a storage medium such as a memory card is loaded in the slot section 61, the device 10 prints the image data stored in the memory medium on sheets of recording paper.

The printer section 11 is configured as an inkjet recording device provided with a refill unit 70 for containing ink to be supplied to a recording head that ejects ink droplets in a front surface of the housing 1. The refill unit 70 has a structure assisting in loading and unloading the ink cartridge. With this arrangement, a user of the multifunction device 10 can perform an replacement of the ink cartridge very simply and quickly.

Figure 2:
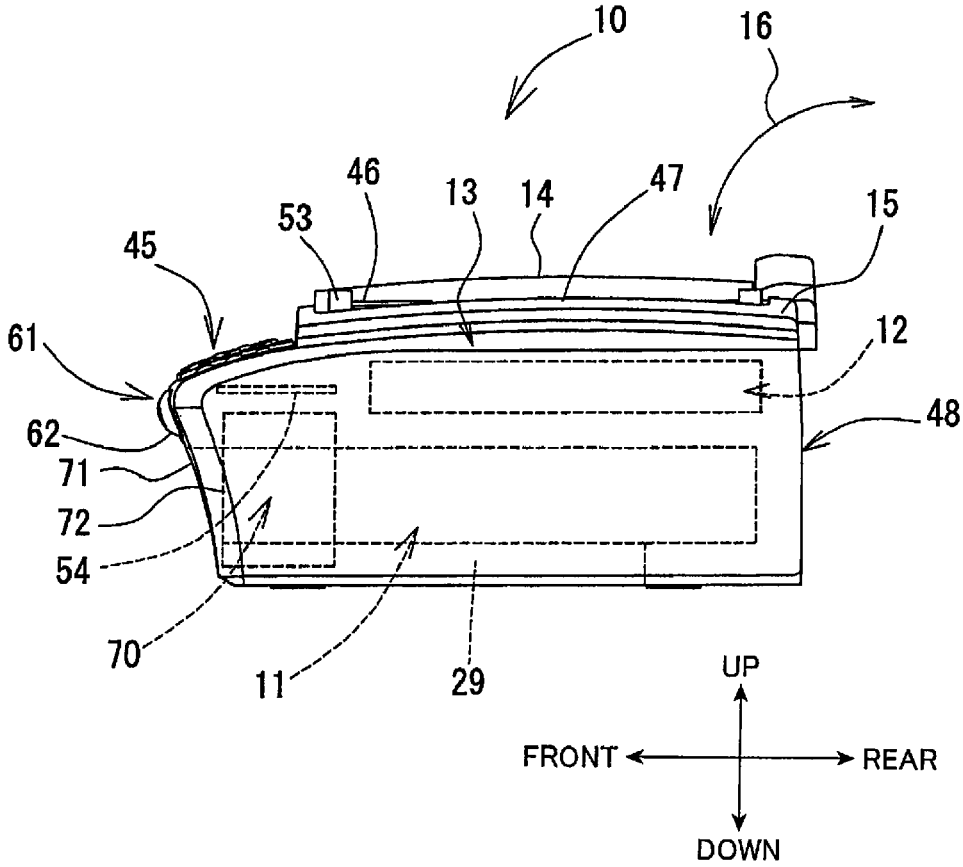
FIG. 2 is a side view showing the multifunction device of FIG. 1.

As shown in FIG. 2, the scanner section 12 has an document mounting section 13 that operates as a flatbed scanner (FBS) and an document cover 15 to cover the FBS 13. The document cover 15 has an automatic document feeder (ADF) 14, and is pivotably attached to the rear side of the document mounting section 13 by a hinge. Thus, the document cover 15 is opened and closed, when the cover 15 is pivoted in the direction indicated by an arrow 16. The document mounting section 13 is formed as a part of the housing 1 of the multifunction device 10. The document cover 15 constitutes a part of the top surface of the multifunction device 10.

Figure 3:
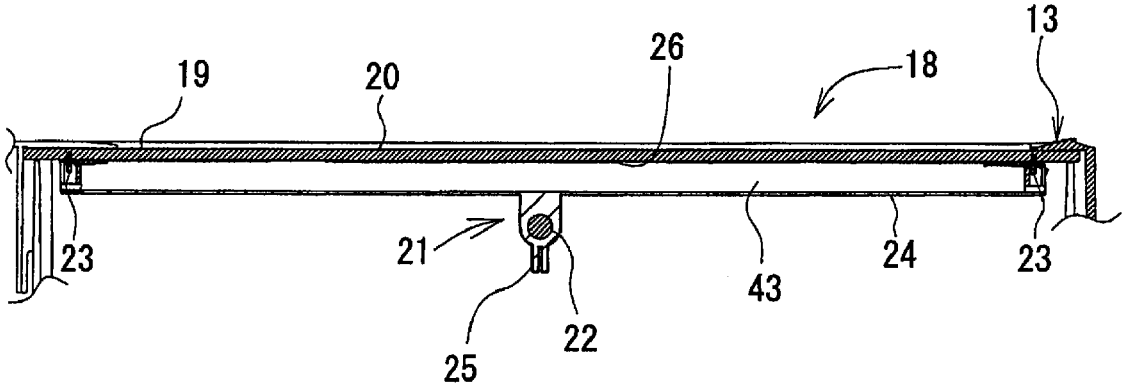
FIG. 3 is a sectional view showing a scanner section.

The document mounting section 13 forms a part of the frame of the scanner section 12. As shown in FIG. 3, a contact glass panel 20 is provided in a top surface 19 of the document mounting section 13. Additionally, an image reading unit 18 is provided in the document mounting section 13. The document is placed between the document cover 15 and the contact glass panel 20. The image reading unit 18 reads the image from the document, as the reading unit 18 moves under the contact glass panel 20 along the contact glass panel 20.

The image reading unit 18 has a contact image sensor (CIS) unit 21, a guide shaft 22, roller units 23 and a belt drive mechanism (not shown). The image reading unit 18 has a CIS. However, an image sensor for a micro optical system such as a charge coupled device (CCD) may be used instead of the CIS. The CIS unit 21 has an oblong box-shaped cabinet 43. The cabinet 43 is engaged with and supported by a carriage 24. The guide shaft 22 is positioned in a direction parallel to the contact glass panel 20. The guide shaft 22 passes through the lower end section 25 of the carriage 24. In other words, the CIS unit 21 is supported to the guide shaft 22, and slides while being guided by the guide shaft 22. The belt drive mechanism has a timing belt (not shown) that is driven by a motor. A part of the timing belt is coupled to the lower end section 25 of the carriage 24. Thus, when the belt drive mechanism is driven, the carriage 24 moves together with the timing belt and. Therefore, the CIS unit 21 moves under the contact glass panel 20.

The roller units 23 are provided at the both ends of the CIS unit 21. The roller unit 23 contacts the rear surface 26 of the contact glass panel 20. Then, when the carriage 24 moves, the roller unit 23 rotates to move in the moving direction of the carriage 24 on the rear surface 26 of the contact glass panel 20. In other words, the roller unit 23 assists a smooth movement of the CIS unit 21. Additionally, the roller unit 23 functions as a spacer for maintaining the distance between the CIS unit 21 and the document placed on the contact glass panel 20 to a constant value.

As shown in FIG. 1, the document cover 15 has the ADF 14. The ADF 14 is configured to successively convey a predetermined number of sheets of documents from an document tray 47 to a sheet discharge tray 46. The mechanism for successively conveying the documents is installed in the document cover 15.

Figure 4:
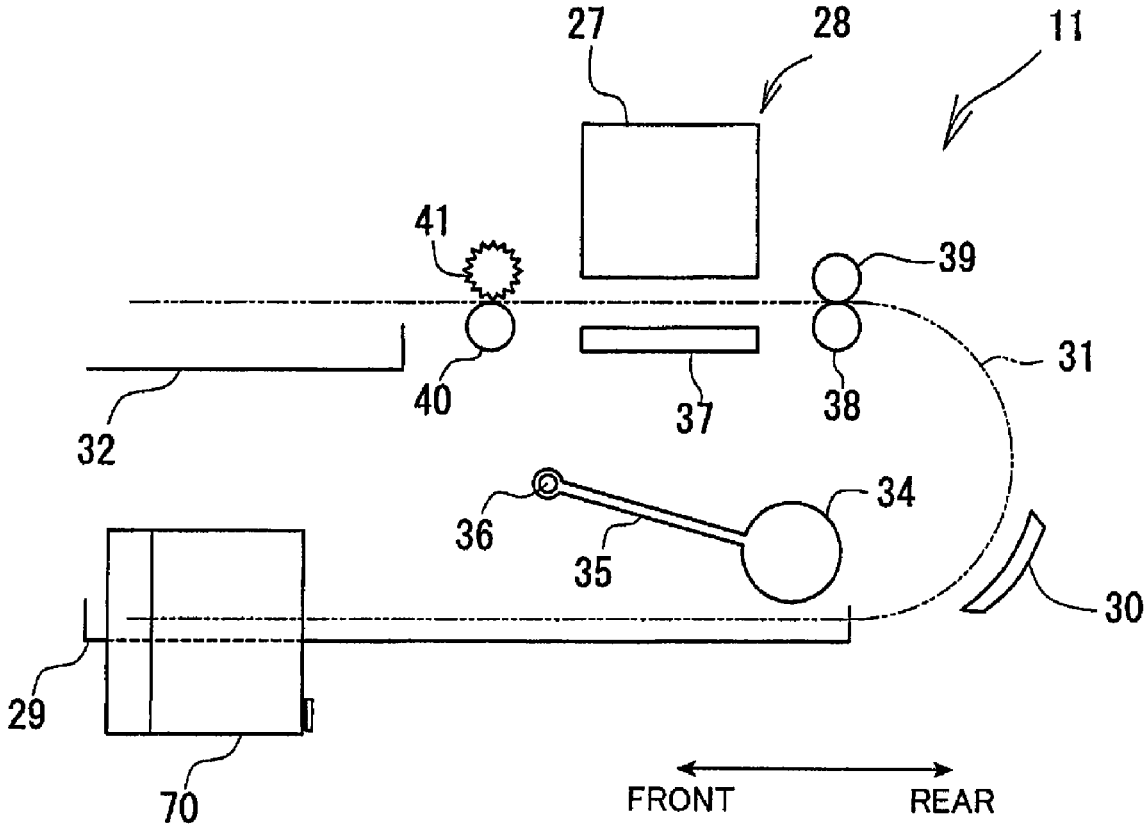
FIG. 4 is a schematic view showing an internal configuration of a printer section.

As shown in FIGS. 2 and 4, the printer section 11 has a frame constituted by the document mounting section 13 and an image recording section 28 that includes an inkjet recording head 27.

As shown in FIG. 4, the printer section 11 has the refill unit 70. As shown in FIG. 1, the refill unit 70 is installed inside the front surface 71 of the casing 1. The refill unit 70 includes four ink cartridges. The ink cartridges include black, yellow, magenta and cyan color ink, respectively. The ink in the ink cartridges is supplied to the recording head 27 through the ink tubes.

As shown in FIG. 2, the casing 1 has a lid 72 in the right side of the front surface 71. The lid 72 opens and closes an opening 73 provided in an end of the front surface 71. More specifically, the lid 72 can move between an opening position for exposing the refill unit 70 from the opening 73, when the lid 72 is forwardly laid down as shown in FIG. 1, and a closing position for closing the opening 73.

As shown in FIG. 1, the casing 1 is provided with an opening 42 at the center of the front surface. A sheet feeding tray 29 is positioned in the opening 42. After image is recorded on the sheet of recording paper fed out from the feeding tray 29, the sheet is then discharged onto the sheet delivery tray 32 provided inside the opening 42. A separator tilt plate 30 is provided beyond the sheet feeding tray 29 (at the right side in FIG. 4). The separator tilt plate 30 separates a sheet of recording paper stocked in the sheet feeding tray 29 and guides the separated paper upward. A sheet conveying passage 31 is formed to extend upward from the separator tilt plate 30. After extending upward, the sheet conveying passage 31 curves leftward to extend from the rear surface toward the front surface of the multifunction device 10. Additionally, the sheet conveying passage 31 passes the image recording section 28 and extends to the sheet delivery tray 32. Therefore, the sheet of recording paper contained in the sheet feeding tray 29 is guided along the sheet conveying passage 31 from below, while changing an orientation thereof, to reach the image recording section 28. The image recording section 28 records an image on the sheet of recording paper conveyed along the sheet conveying passage 31. Subsequently, the recording sheet of paper is discharged to the sheet delivery tray 32.

As shown in FIG. 4, a sheet feeding roller 34 is provided above the sheet feeding tray 29. The sheet feeding roller 34 separates the sheet of recording paper stacked in the sheet feeding tray 29 one by one to supply the separated sheet to the sheet conveying passage 31. The sheet feeding roller 34 is journaled at the front end of a sheet feeding arm 35. The sheet feeding arm 35 can be moved up and down so as to contact the sheet feeding tray 29. The sheet feeding roller 34 is connected to a motor through a drive/transmission mechanism (not shown). The drive/transmission mechanism is formed by a plurality of mutually engaged gears. When the motor is driven, the drive force is transmitted to the sheet feeding roller 34 to rotate the sheet feeding roller 34. The rotating sheet feeding roller 34 sends the sheet of recording paper to the sheet conveying passage 31.

The sheet feeding arm 35 is supported by a base end shaft 36 so as to pivot about the base end shaft 36. As a result, the sheet feeding arm 35 can swing up and down about the base end shaft 36. The sheet feeding arm 35 is urged to the sheet feeding tray 29 by means of a sheet feeding clutch or a spring (not shown) when the sheet feeding tray 29 is placed in position. The sheet feeding arm 35 is retracted upward when the tray 29 is pulled out. When the sheet feeding arm 35 pivots downward, the sheet feeding roller 34 journaled at the front end thereof contacts and presses the surface of the sheet of recording paper on the sheet feeding tray 29. When the sheet feeding roller 34 rotate, contacting the sheet, the frictional force between the roller surface of the sheet feeding roller 34 and the sheet of recording paper sends the uppermost sheet of recording paper to the separator tilt plate 30. The front end of the sheet of recording paper contacts the separator tilt plate 30, and is guided upward so that the sheet of recording paper is sent into the sheet conveying passage 31. When the uppermost sheet of recording paper is sent by the sheet feeding roller 34, another sheet of recording paper located immediately under the uppermost sheet may be sent by a friction force and/or static electricity. However, feed of the sheet of recording paper is blocked by the separator tilt plate 30.

The sheet conveying passage 31 is defined by an outer guide surface and an inner guide surface opposing at predetermined intervals except the image recording section 28. In the multifunction device 10, the outer guide surface is constituted by the inner wall of the frame of the printer section 11 having the document mounting section 13. The inner guide surface is constituted by surfaces of the guide member provided in the frame. Conveyance rollers may be provided at the position where the sheet conveying passage 31 is curved. Conveyance rollers may be rotatable about a rotation axis extending in the width direction of the sheet conveying passage 31. The conveyance rollers are installed in the multifunction device 10 to expose the roller surfaces thereof to the outer guide surface and the inner guide surface. Due to the conveyance rollers, the sheet of recording paper is conveyed smoothly, while contacting the guide surfaces at positions where the sheet conveying passage 31 is curved.

The image recording section 28 is provided on the downstream side with respect to the U turn portion of the sheet conveying passage 31. A platen 37 is provided opposite to the recording head 27. The sheet of recording paper is sent onto the platen 37. The recording head 27 ejects ink droplets onto the sheet of recording paper placed on the platen 37. The recording head 27 is mounted on a carriage (not shown). The carriage is driven by a carriage return (CR) motor to reciprocate in the direction perpendicular to the conveying direction of the sheet. The position and the reciprocation of the recording head 27 axe monitored by the encoder for the carriage. The recording head 27 ejects ink droplets of the different colors onto the sheet of recording paper, while being driven to reciprocate. As a result, an image is recorded on the sheet of recording paper.

A driving roller 39 and a press roller 38 are provided on the upstream side of the sheet conveying passage 31 with respect to the recording head 27. The driving roller 39 is driven to rotate by a linefeed (LF) motor. The driving roller 39 and the press roller 38 pinch the sheet of recording paper conveyed along the sheet conveying passage 31. The sheet of recording paper is moved to the downstream side of the sheet conveying passage 31 due to the rotation of the driving roller 39 to be placed on the platen 37.

A sheet discharge roller 40 and a press roller 41 are provided on the downstream side of the sheet conveying passage 31 with respect to the recording head 27. The sheet discharge roller 40 is driven to rotate by the LF motor that drives the driving roller 39. More specifically, the sheet delivery roller 40 is driven in synchronism with the driving roller 39 through an interlocking mechanism. The sheet delivery roller 40 and the press roller 41 pinch the sheet of recording paper onto which ink droplets are ejected. When the sheet delivery roller 40 is driven to rotate, the sheet of recording paper is sent to the downstream of the sheet conveying passage 31.

The press roller 38 is resiliently urged against the driving roller 39 so as to press the driving roller 39 at a predetermined pressure. Therefore, when the sheet of recording paper moves between the driving roller 39 and the press roller 38, the press roller 38 cooperates with the driving roller 39 to pinch the sheet of recording paper, while resiliently retreating by the distance corresponding to the thickness of the sheet of recording paper. Because the sheet of recording paper is pinched by the driving roller 39 and the press roller 38, the rotary force of the driving roller 39 is reliably transmitted to the sheet of recording paper. The press roller 41 is provided in a similar manner to the sheet discharge roller 40. Note, however, that the press roller 41 presses against and contacts the recorded sheet of recording paper, so that the surface of the roller is formed to have a spur in order to avoid the image recorded on the sheet of recording paper from degrading.

The sheet of recording paper that is pinched by the driving roller 39 and the press roller 38 is intermittently moved on the platen 37 by a linefeed. The recording head 37 is driven to reciprocate every linefeed to record an image sequentially from the front end side of the sheet of recording paper. The sheet of recording paper on which an image is recorded is pinched by the sheet delivery roller 40 and the press roller 41 at the front end side thereof. More specifically, the sheet of recording paper is moved intermittently by a linefeed, while the front end side thereof is pinched by the sheet delivery roller 40 and the press roller 41, and the rear end side thereof is pinched by the driving roller 39 and the press roller 38. An image is recorded by the recording head 27 on the sheet of recording paper as the sheet is being moved. After the image is recorded in a predetermined region of the sheet of recording paper, the sheet delivery roller 40 is continuously driven to rotate. The sheet of recording paper pinched by the sheet delivery roller 40 and the press roller 41 is discharged to the sheet delivery tray 32.

As shown in FIG. 1, an operation panel 45 is provided in the top inclined surface of the document mounting section 13. The operation panel 45 is a device for operating the printer section 11 and the scanner section 12. The operation panel 45 has different operation keys 56 through 58, and a liquid crystal display section 59 in the top surface 44. Additionally, a control device (not shown) for controlling the entire operation of the multifunction device 10 including the printer section 11. The scanner section 12 is provided below the document mounting section 13.

As shown in FIG. 2, a control substrate 54 is provided below the operation panel 45 (inside the document mounting section 13). The various operation keys 56 through 58 on the operation panel 45 are connected to the control substrate 54 through a flat cable (not shown). The control substrate 54 is connected to the control device to process instructions entered from the various operation keys 56 through 58 and control the operation of the multifunction device 10.

The user of the multifunction device 10 inputs a desired command by using the operation keys 56 through 56. The multifunction device 10 performs a predetermined operation in response to the entered command. As described above, the personal computer is connected to the multifunction device 10. The multifunction device 10 operates in response to the command transmitted from the personal computer in addition to the command from the operation panel 45.

As shown in FIG. 1, the slot section 61 is provided in the front surface of the multifunction device 10. A storage device such as a memory card can be inserted in the slot section 61. Image data stored in the memory card is read out from the memory card in the slot section 61. Information relating to the image data is displayed on the liquid crystal display section 59. Then, the image displayed on the liquid crystal display section 59 is recorded on a sheet of recording paper by the printer section 11. The operation panel 45 is used for entering data required for this operation.

The refill unit 70 has a unit main body 74 and four ink cartridges 63 removably loaded in the unit main body 74.

The unit main body 74 includes a casing 75 for accommodating the ink cartridges 63, four doors 76 attached to the casing 75, and guiding members 77 provided at the respective doors 76.

Figure 6:
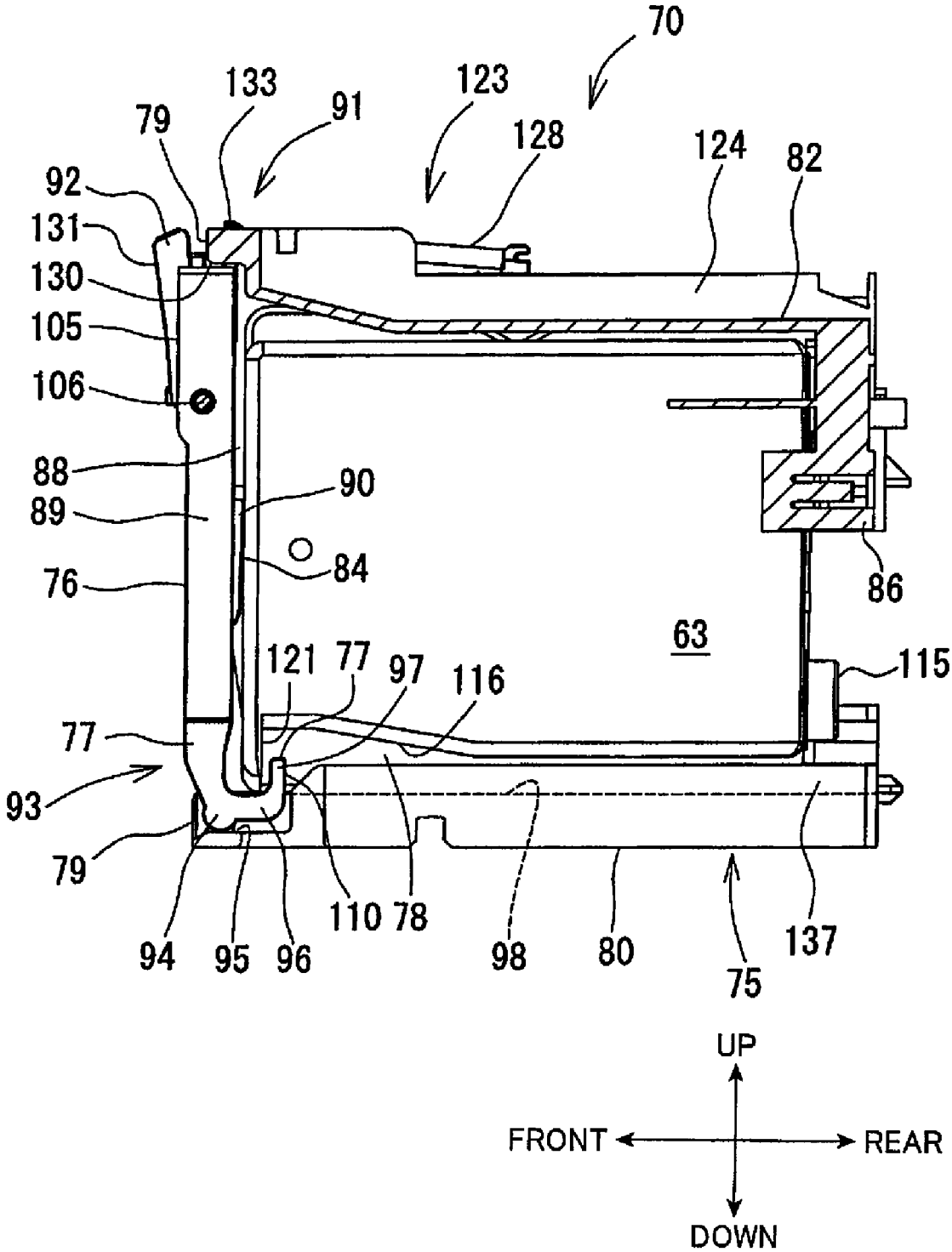
FIG. 6 is a cross sectional view taken along lines VI-VI in FIG. 5.

As shown in FIG. 6, the casing 75 is made from resin and formed to have a substantially rectangular parallelepiped. Containing chambers 78 for accommodating the ink cartridges 63 are formed in the casing 75 by partitioning the inside of the case 75. The casing 75 has four containing chambers 78. Four ink cartridges 63 are loadable in the respective containing chambers 78. The profile of the inner walls of each of the containing chambers 78 matches the profile of the outer surfaces of each of the ink cartridges 63. Therefore, each of the ink cartridges 63 is reliably accommodated in the casing 75 without any extra play.

The casing 75 has a bottom plate 80, a pair of lateral plates 81, 81 standing from the left and right lateral edges of bottom plate 80, a top plate 82 provided to bridge the lateral plates 81, and partition walls (not shown) for partitioning the containing chambers 78. The partitioning walls are provided depending on the number of ink cartridges 63 in the casing 75. It should be noted that the partitioning walls do not need to completely partition the inside of the casing 75. The partitioning walls may be formed as rib-like structures on the bottom plate 80 for separating neighboring containing chambers 78 to each other. Preferably, the bottom plate 80, the lateral plates 81, 81, the top plate section 82, and the partitioning walls are integrally formed.

The containing chamber 78 have the same internal structure to one another. The following description will explain one containing chamber 78.

A push rod (not shown) is provided in the rear surface of the casing 75 to project inside the containing chambers 78. When the ink cartridge 63 is loaded in the casing 75, the push rod is inserted into an air lead-in valve 85 provided in the ink cartridges 63 (see FIGS. 7, 13 and 14). Accordingly, air can be introduced into the ink cartridge 63 through the air lead-in valve 85 to feed ink from the ink cartridge 63 smoothly to the recording head 27. As shown in FIG. 6, a connector 86 for a liquid level sensor is provided on the rear surface of the casing 75. The connector 86 is connected to the liquid level sensor 87 (see FIG. 13) provided at the ink cartridge 63, when the ink cartridge 63 is loaded in the casing 75. The connector 86 is connected to the control device so that the control device constantly monitors the remaining amount of the ink contained in the ink cartridge 63.

The upper surface of the bottom plate 80 constitutes a mounting surface 98 for mounting the ink cartridges 63. The height of the mounting surface 98 from the lower surface of the bottom plate 80 is selected to a proper value for loading the ink cartridge 63 to the containing chamber 78. Accordingly, after the ink cartridge 63 is loaded in the containing chamber 78, the ink supply tube (not shown) is readily inserted into an ink supply valve 115 and the push rod is readily inserted into the air lead-in valve 85 (see FIG. 14). Simultaneously, the connector 86 can be readily connected to the liquid level sensor 87 of the ink cartridges 63.

Figure 7:
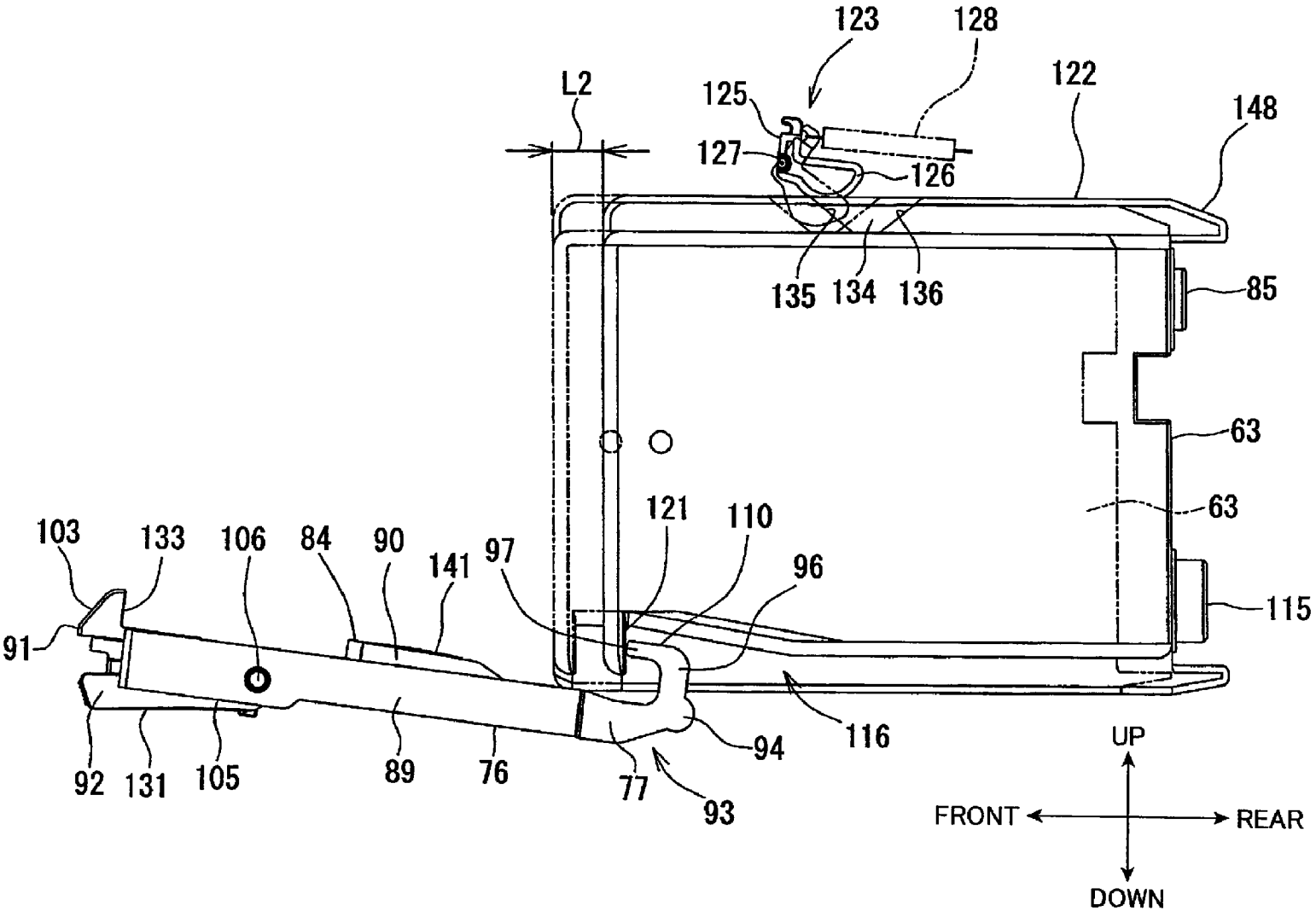
FIGS. 7 and 8 are side views showing the refill unit.

A Rib 124 projects downward from the top plate 80 (See FIG. 6) so that the rigidity of the casing 75 is enhanced. Referring to FIG. 7, the top plate 80 is provided with a swing arm 123.

The swing arm 123 has a substantially L-shaped profile as a whole, and has a first arm 125 and a second arm 126 extending in a direction crossing the first arm 125. A support shaft 127 is provided between the first arm 125 and the second arm 126. The swing arm 123 is journaled by the support shaft 127. A tension spring 128 is provided between the first arm 125 and the top plate 82. Therefore, the swing arm 123 is resiliently and constantly urged to pivot clockwise and maintain a posture as indicated by double-dotted chain lines in FIG. 7. Since the swing arm 123 is resiliently urged, the swing arm 123 can maintain the posture as indicated by solid lines because of a reaction force against the resilient force. The swing arm 123 contacts and presses the top surface 122 of the ink cartridge 63 to forcibly push out the ink cartridge 63 from above.

Figure 5:
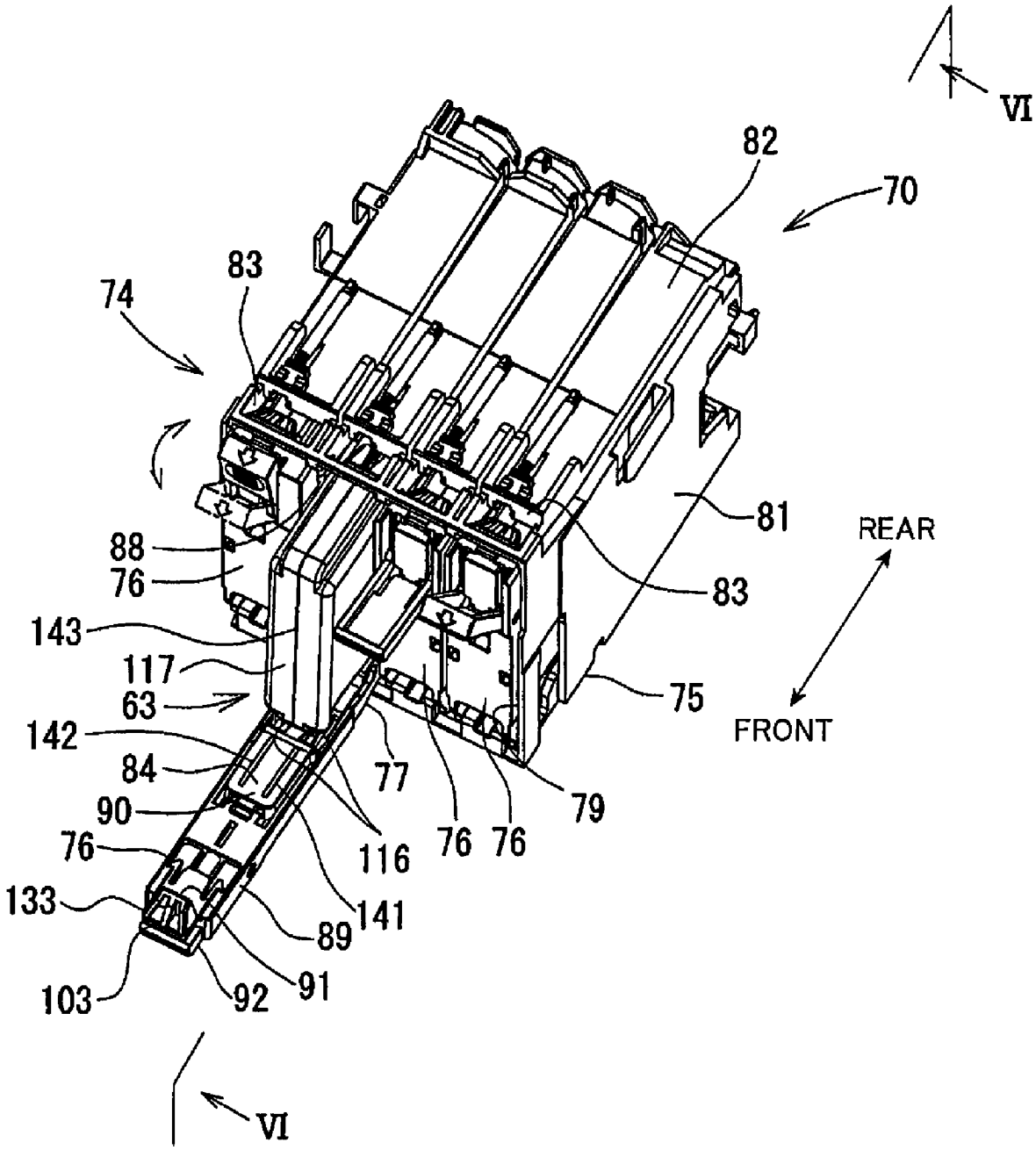
FIG. 5 is a perspective view showing a refill unit.

As shown in FIGS. 5 and 6, an opening 88 is provided in the front surface 79 of the casing 75. In other words, the containing chamber 78 is communicated with the opening 88 so that the ink cartridge 63 is loaded in and unloaded from the containing chamber 78 through the opening 88.

As shown in FIG. 6, the door 76 is provided at the opening 88 to open and close the opening 88. When the door 76 is closed, an ink cartridge 63 is reliably installed in the c containing chamber 78. When the door 76 is open, the ink cartridge 63 is easily loaded in or unloaded from the containing chamber 78.

Figure 9:
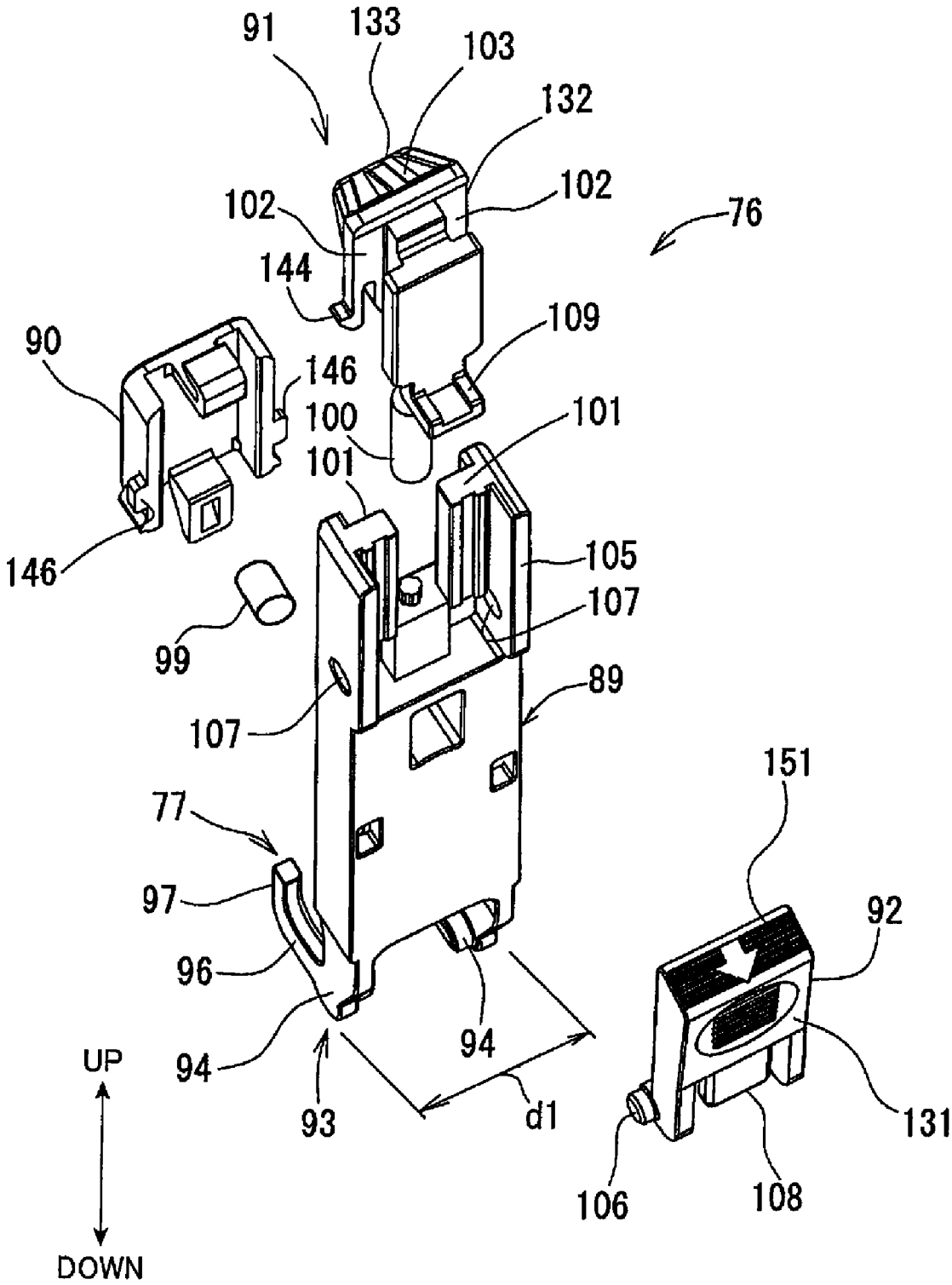
FIGS. 9 and 10 are exploded perspective views showing a door in the refill unit.
Figure 10:
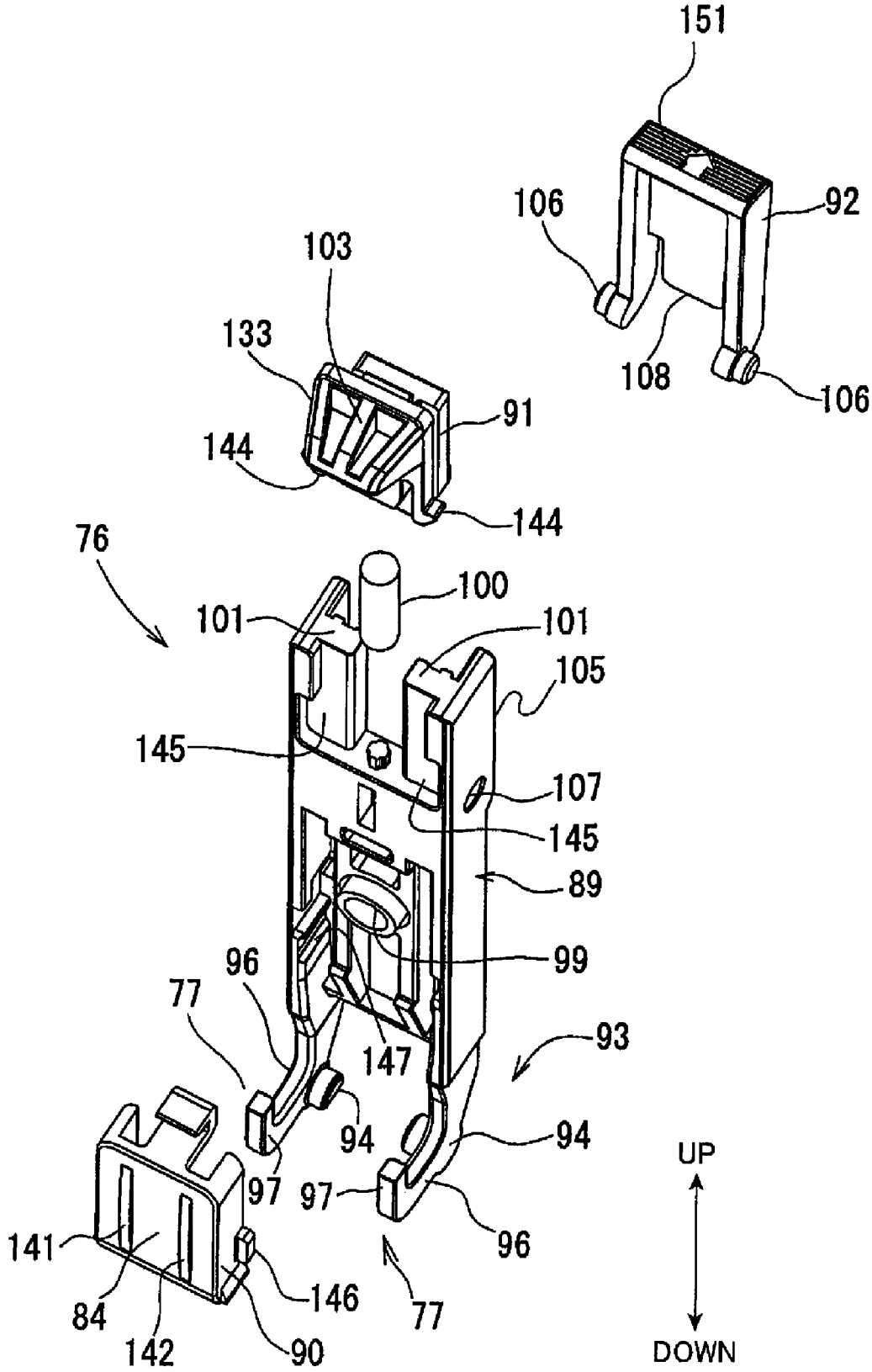

As shown in FIGS. 5 and 6, the door 76 has a door main body 89, a press member 90 provided on the door main body 89, a lock member 91, and a lock release lever 92. These components are made from resin. As shown in FIGS. 6, 9 and 10, the door main body 89 has an flat oblong rectangular shaped. The outer profile of the door main body 89 matches that of the opening 88. A pair of pivot 94 is formed at the lower end 93 of the door main body 89. The pair of pivots 94 is integrally formed with the door main body 89. As shown in FIG. 6, the pivots 94 are supported at a lower part of the front surface 79 of the casing 75. More specifically, bearing portions 95 are formed at the front end of the bottom plate 80. The pivots 94 are journaled in the respective bearing portions 95. Accordingly, the door 89 stands up to close the opening 88, as shown in FIG. 6, and lies down to open the opening 88, as shown in FIG. 8.

The guiding member 77 is provided at the lower end 98 of the door main body 89. The guiding member 77 is integrally formed with the door main body 89. The guiding member 77 has a substantially L-shaped profile and includes an extended sections 96 and a bent section 97. The extended section 96 continuously extends from the lower end 93. As shown in FIG. 6, the extended section 96 extends rearward from the lower end 93, when the door 76 is closed. The bent section 97 extends upward from the rear end of the extended section 96, and forms an angle of about 90° with the extended section 96. The bent section 97 projects upward. The tip end of the bent section 97 is positioned above the mounting surface 98, when the door 76 is closed. The door main body 89 pivotally moves about the pivot section 94. As a result, the guiding member 77 also pivotally moves about the pivot section 94, as shown in FIGS. 6 and 8. As the guiding member 77 is pivotally moved, the ink cartridge 63 is unloaded from the containing chamber 78.

Figure 8:
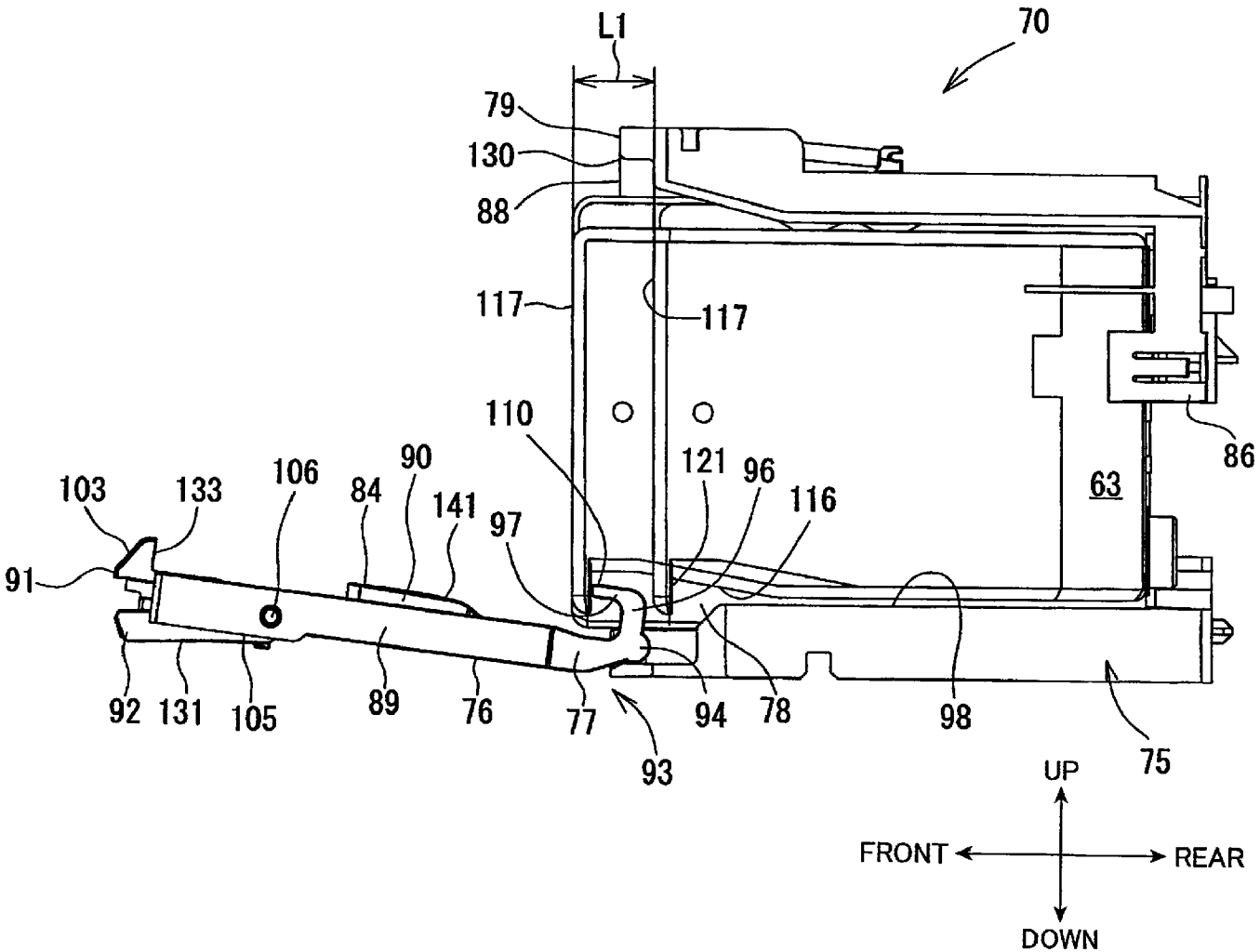

As shown in FIG. 8, when the door 76 is opened, the bent section 97 pivotally moves counterclockwise about the pivot section 94. At this time, as the bent section 97 pivotally moves, the outer wall surface 110 is changed from a vertically standing state (FIG. 6) to a horizontally state (FIG. 8). The length of the extended sections 96 is set to a predetermined dimension. Accordingly, when the bent section 97 pivots, the outer wall surface 110 is located partially above the mounting surface 98. In other words, the outer wall surface 110 is located substantially on the extending line of the mounting surface 98 in the forward and backward direction. Then, when the door 76 is opened, the outer wall surface 110 operates as a guide surface for guiding the ink cartridge 63 onto the mounting surface 98 into the containing chamber 78. In other words, the guiding members 77 operate not only as a member for unloading the ink cartridge 63 from the containing chamber 78, but also as a guide member for loading the ink cartridge 63 into the containing chamber 78.

In this embodiment, each door main body 89 is provided with a pair of guiding members 77. The guiding members 77 are provided opposing to each other at the lower ends of the door main body 89, as shown in FIG. 10. Due to the pair of guiding members 77, the guiding members 77 sandwich the ink cartridge 63 in the horizontal direction to support the ink cartridge 63. In this embodiment, the distance d1 between the guiding members 77 (see FIG. 9) is formed smaller than the width d2 of the ink cartridge 63 (see FIG. 14).

As shown in FIGS. 6, 8, 9 and 10, the press member 90 is provided on the inner surface of the door main body 89. The press member 90 is provided with claws 146 on the both lateral surfaces thereof. The door main body 89 is provided with claw receiving sections 147 for receiving the claw 146 (FIG. 10). The claw 146 projects from the lateral surface of the press member 90. The claw receiving section 147 is a groove formed in the door main body 89 to extend forwardly and backwardly. The claw 146 is slidably received by the claw receiving section 147, so that the press member 90 are supported in such a way to move back and forth with respect to the door main body 89. In other words, the press member 90 can switch a condition thereof between a projecting condition to project from the inner surface of the door main body 89 (see FIG. 8) and a retreating condition to retreat into the door main body 89 (see FIG. 6). As shown in FIG. 10, a coil spring 99 is provided between the press member 90 and door main body 89. Thus, the press member 90 is resiliently urged to maintain the projecting condition, as shown in FIG. 8.

As shown in FIG. 6, when the door 76 is closed, the press member 90 contacts the front surface of the ink cartridge 63 to be pressed by the ink cartridge 63 into the retreating condition. Thus, the ink cartridge 63 is urged by the press member 90 due to the resilient force of the coil spring 99 and pressed backward, so that the ink cartridge 63 is aligned with respect to the casing 75. Therefore, ink is reliably prevented from leaking from the ink supply valve 115 of the ink cartridge 63.

In this embodiment, the press member 90 is formed to have a flat plate shape. The wall surface 84 of the press member 90, facing the front surface of the ink cartridge 63 when the door 76 is closed, is formed flat. A pair of ridges 141, 142 are formed on the wall surface 84, as shown in FIGS. 5 and 10. Thus, the ridges 141, 142 contact and press the front surface of the ink cartridge 63 when the door 76 is closed. The ridges 141, 142 are separated from each other by a predetermined distance in the horizontal direction of the door 76. Therefore, when the door 76 is closed, the press member 90 contacts the two lateral sides of the bonding section 143 of the ink cartridge 63. However, the ridges 141, 142 do not contact the bonding section 143.

Referring to FIG. 6, a lock member 91 is provided in the top end of the door main body 89. Referring to FIG. 9, the lock member 91 includes a main shaft section 132, a key section 133 extending from the top end of the main shaft section 132 and projecting inside the casing 75, and a seat section 109 extending from the bottom end of the main shaft section 132 and projecting outside of the casing 75.

The lock member 91 is supported so as to be movable upwardly and downwardly with respect to the door main body 89. Slide rails 101 are provided at the top end of the door main body 89, extending upwardly and downwardly. The main shaft section 132 of the lock member 91 is provided with slide grooves 102 extending upwardly and downwardly (see FIG. 9). The slide rails 101 are fitted in the slide grooves 102, respectively, so that the lock member 91 can slide upwardly and downwardly.

The main shaft section 132 is provided with claws 144 at both of the lateral surfaces thereof. The claw 144 projects outward from the main shaft section 132. When the lock member 91 is engaged in the door main body 89, the claws 144 is received in the claw receiving section 145 provided at the main shaft section 132 (see FIG. 10). The claw receiving section 145 is a groove extending vertically by a predetermined length. Therefore, when the lock member 91 slides upward or downward, the claw abuts the inner wall of the claw receiving section 145 to restrict the vertical sliding movement of the lock member 91. The lock member 91 projects upward from the top end of the door main body 89 when the lock member 91 slides upward with respect to the door main body 89. On the other hand, the lock member 91 retreats in the door main body 89, when the lock member 91 slides downward with respect to the door main body 89. The sliding range of the lock member 91 corresponds to the vertical length of the claw receiving section 145.

As shown in FIG. 10, a coil spring 100 is provided between the lock member 91 and the door main body 89. The lock member 91 is constantly resiliently urged to project upward from the door main body 89. Additionally, a top surface 103 of the key section 133 of the lock member 91 is inclined downwardly from the horizontal direction. Thus, as shown in FIGS. 6 and 8, when the door 76 is closed from the opening condition, the top surface 103 of the lock member 91 contacts the upper edge 130 of the opening 88 (see FIG. 8). And then, when the door 76 is pivotally moved to the closed condition, the lock member 91 is urged against the upper edge section 130 and retreats inside the door main body 89. Then, when the door 76 is completely closed, the lock member 91 projects from the door main body 89, and the key section 133 is engaged with the casing 75 (see FIG. 6). More specifically, the key section 133 is engaged with the lock member engaging hole 83 (see FIGS. 5 and 11) provided in the casing 75. Since the lock member 91 is constantly resiliently urged by the coil spring 100 to project from the door main body 89, the door 76 is maintained closed.

As shown in FIGS. 9 and 10, the lock release lever 92 is formed to have a rectangular plate shape, and attached to an upper portion of a the outer surface 105 of the door main body 89. A support pin 106 is provided at the lower end of the lock release lever 92. A pin support hole 107 is provided at the door main body 89. The pin 106 is received in the pin support hole 107. Accordingly, the lock release lever 92 is pivotable about the support pin 106. More specifically, the lock release lever 92 is pivotable to take a standing position in which the lever 92 stands substantially in parallel with the outer surface 105 of the door main body 89, an inclined position in which the lever 92 is inclined to about 45° (see FIG. 11), and a lying position in which the lever 92 lies substantially horizontally (see FIG. 12). When the lock release lever 92 is standing substantially in parallel with the outer surface 105 of the door main body 89, this condition of the lever 92 is defined as "standing position." When the lock release lever 92 is inclined to about 45°, this condition of the lever 92 is defined as "neutral position." When the lock release lever 92 lies substantially horizontally, this condition is defined as "lying position". An arrow indicator is provided on the top surface 151 to show the moving direction of the lock release lever 92.

The bottom surface 108 of the lock release lever 92 is formed to have a predetermined shape. The bottom surface 108 operates as a cam that forces the lock member 91 to slide vertically when the position of the lock release lever 92 changes. The shape of the bottom surface 108 is not limited to the above shape. However, any shape of the bottom surface 108 may be acceptable if the lock member 91 is slided in conjunction with the pivotal movement of the lock release lever 92.

Figure 11:
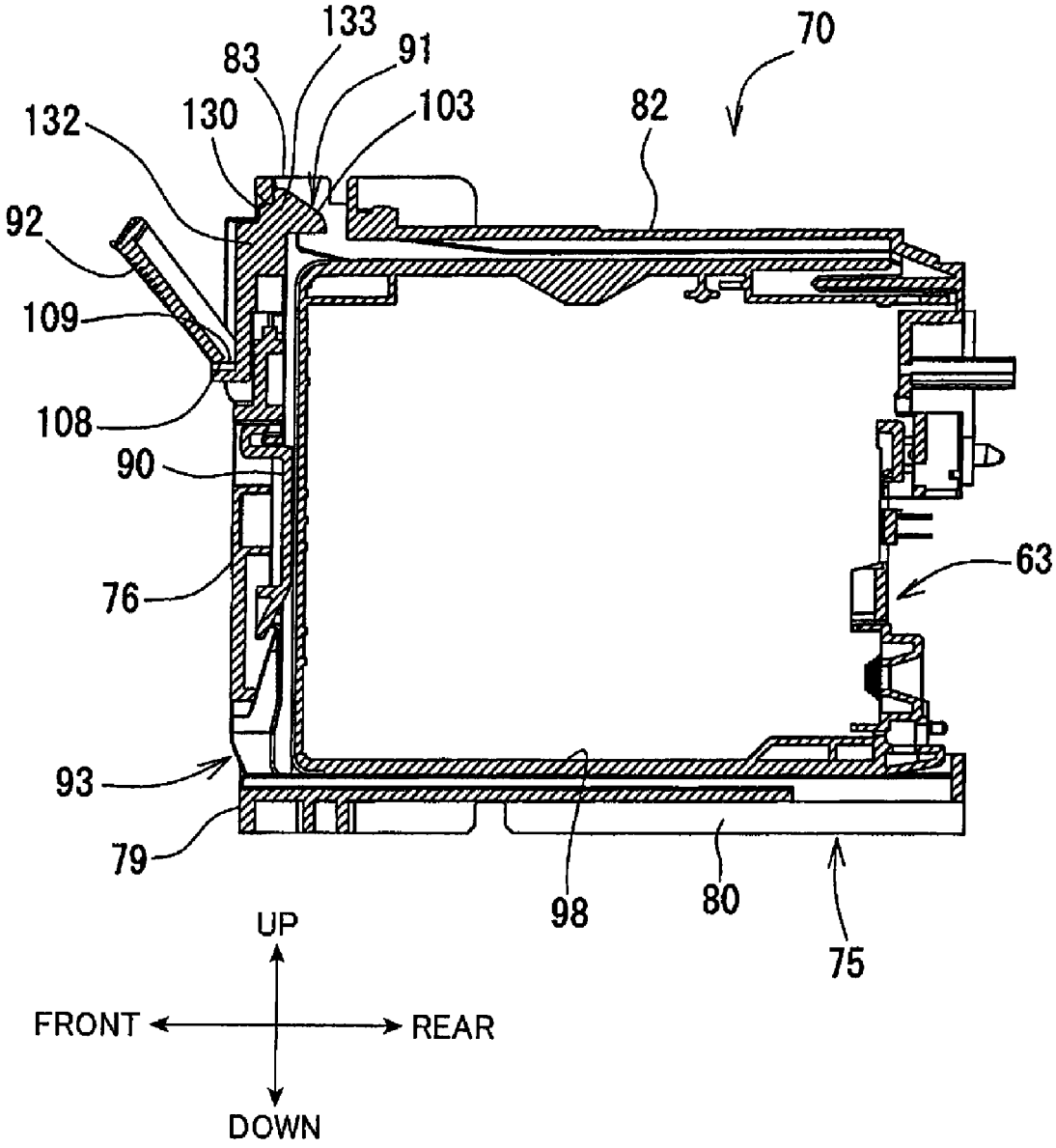
FIG. 11 is a cross sectional view showing the refill unit 70 with a lock release lever 92 being at a neutral position.

As described above, the bottom surface 108 of the lock release lever 92 operates as a cam. When the lock member 91 is engaged with the lock member engaging hole 83 of the casing 75, i.e., when the door 76 is closed (FIG. 11) with respect to the casing 75, the lock release lever 92 is pivotable about the support pin 106 (see FIGS. 9 and 10) within the rotary range between the standing position and the neutral position. In this embodiment, the center of gravity of the lock release lever 92 is determined in such a way that the lever 92 is maintained in the neutral position as shown in FIG. 11 due to the own weight.

When the lock release lever 92 is displaced to the neutral position, the bottom surface 108 comes to contact the seat section 109 of the lock member 91. In this state, the lock release lever 92 tends to further rotate clockwise by the own weight, as shown in FIG. 11. In other words, the lock release lever 92 tends to rotate to move the lock member 91 downward. However, since the lock member 91 is resiliently urged upward by the coil spring 100, the lock member 91 is not displaced only by the own weight of the lock release lever 92 so that the lock member 91 projects upward from the top end of the door main body 89 and maintains the engaged condition with the lock member engaging hole 83.

Figure 12:
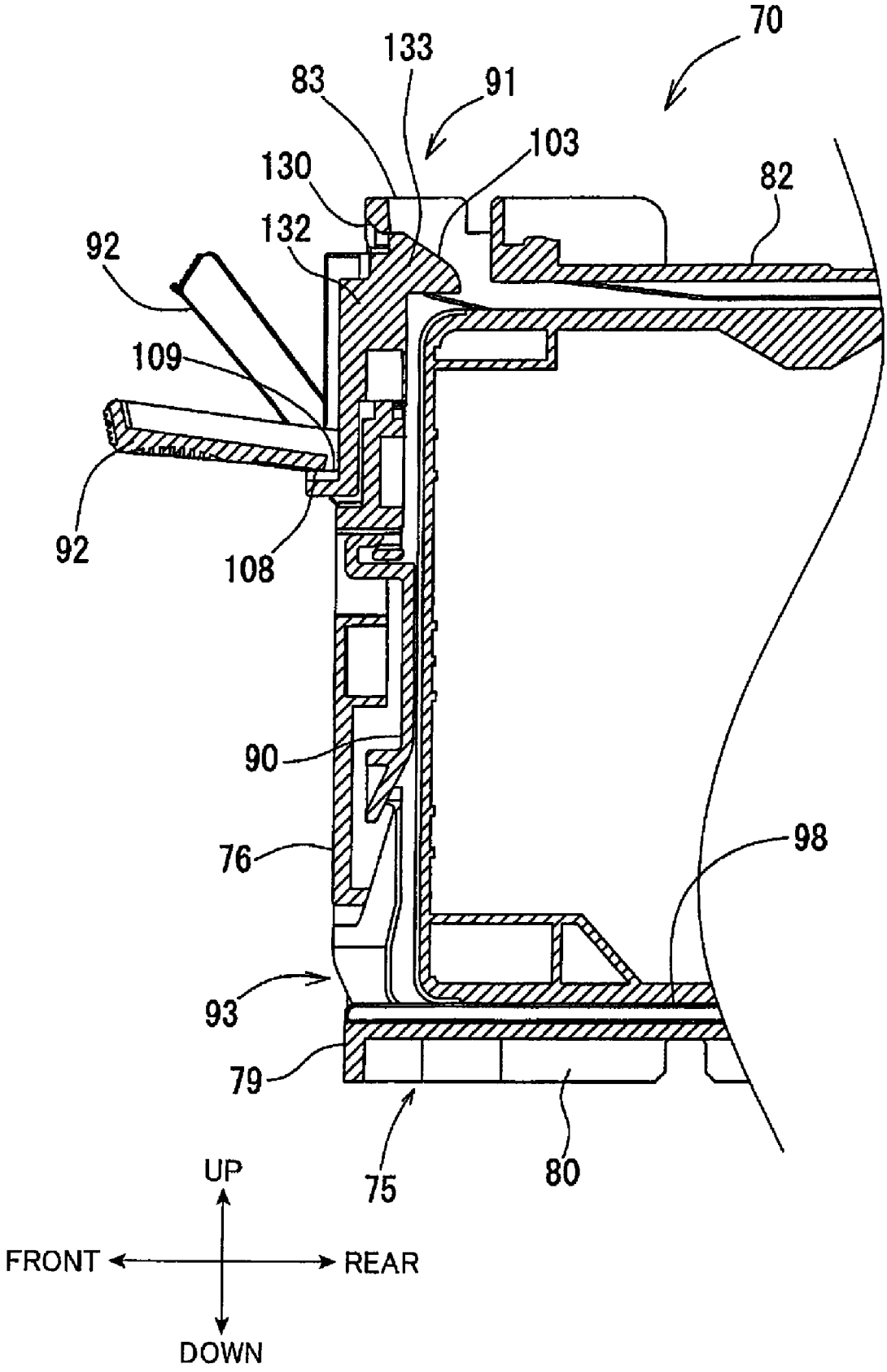
FIG. 12 is a partial enlarged view showing a front portion of the refill unit.

When the lock release lever 92 is forced to further pivot anticlockwise as shown in FIG. 12, for example, when the operator tries to move the lock release lever 92 in order to replace the ink cartridge 63, the lock release lever 92 is displaced to the lying position. When the lock release lever 92 is displaced to the lying position, the bottom surface 108 is pivoted about the support pin 106 and presses down the seat section 109 of the lock member 91. As a result, the lock member 91 moves downward against the resilient force of the coil spring 100 to retreat inside the door main body 89. When the lock member 91 retreats, the door 76 becomes unlocked, and is then opened.

The lock member 91 is constantly urged due to the resilient force of the coil spring 100. The lock member 91 projects from the door main body 89 uppermost when the rotary force being exerted to the lock release lever 92 is removed, or the operator releases the hand holding the lock release lever 92. At this time, the lock release lever 92 is forcibly displaced to the standing position. In other words, as shown in FIG. 8, when the door 76 is opened as shown in FIG. 8, the lock release lever 92 is substantially accommodated in the door main body 89. Therefore, referring to FIGS. 1, 5 and 8, when the ink cartridge 63 is replaced, the lock release lever 92 is completely accommodated in the door main body 89, so that the door 76 can be fully opened about the pivot sections 94 into a substantially horizontal state. Accordingly, the operator can replace the ink cartridge 63 with ease.

Additionally, the two ridges 141, 142 provided on the wall surface 84 of the press member 90 cooperate with the guide section provided between the bent sections 97 to serve as guide, when the ink cartridge 63 is loaded in the containing chamber 78. In other words, when the ink cartridge 63 is loaded into the containing chamber 78, the operator only has to place the ink cartridge 63 on the ridges 141, 142, facing the bottom surface of the ink cartridge 63 thereto, place the front end part of the ink cartridge 63 between the bent sections 97, and then push the ink cartridge 63 into the containing chamber 78. On the other hand, when the ink cartridge 63 is unloaded from the containing chamber 78, the operator only has to pull out the ink cartridge 63 between the bent sections 97 until the bottom surface thereof rides on the ridges 141, 142.

In this embodiment, the lock release lever 92 is at the neutral position when the door 76 closes the casing 75. In other words, the lock release lever 92 is inclined toward the operator, when the door 76 is closed. Accordingly, this structure provides an advantage that the operator can operate the lock release lever 92 with ease. Meanwhile, since the refill unit 70 is provided in the front surface 71 of the multifunction device 10, as shown in FIG. 1. Therefore, the multifunction device 10 needs a large space for containing the refill unit 70, because the lock release lever 92 is placed at the neutral position and inclined to the front surface side in the multifunction device 10.

However, in this embodiment, when the door 76 closes the casing 75, the lock release lever 92 is freely pivotable between the neutral position and the standing position, so that the refill unit 70 can be placed near the peripheral edge of the opening 73. Even if the refill unit 70 is placed near the peripheral edge of the opening 73, the inner wall surface of the lid 72 contacts the lock release lever 92 when the lid 72 is closing, and the lock release lever 92 is then pushed by the lid 72 and displaced to the standing position. Therefore, the multifunction device 10 can be made compact.

The ink cartridge 63 contains ink in a cartridge main body 111. In this embodiment, the refill unit 70 is configured to accommodate four ink cartridges 63. The ink cartridges 63 contain cyan, magenta, yellow, and black inks, respectively. As clearly seen from FIGS. 1 and 5, the ink cartridge 63 for black ink has a greater width than those of the ink cartridges 63 for the other colors. This is because generally the rate of consumption of black ink is relatively high, and black ink is consumed to a large extent. All the ink cartridges 63 for the other inks than black have identical structures.

The cartridge main body 111 is made from resin. The cartridge main body 111 has a thin rectangular parallelepiped as a whole and an ink tank for containing ink. The cartridge main body 111 is formed from two tray-shaped members 112, 113, which are bonded to each other by welding. The bonding section 143 is produced by bonding the tray-shaped members 112, 113.

An air lead-in valve 85 is provided at the rear surface 114 of the cartridge main body 111. A check valve is provided at a remote position from the air lead-in valve 85. The check valve is opened, when the ink cartridge 63 is accommodated in the casing 75. The push rod provided at the casing 75 is inserted into the air lead-in valve 85. An ink supply valve 115 is also provided at the rear surface 114 of the cartridge main body 111. When the ink cartridge 63 is loaded in the casing 75, the ink supply tube provided at the casing 75 is in fluid communication with the ink supply valve 115 to assist feeding ink to the recording head 27. Additionally, a liquid level sensor 87 for detecting a level of the liquid is also provided at the rear surface 114.

Figure 14:
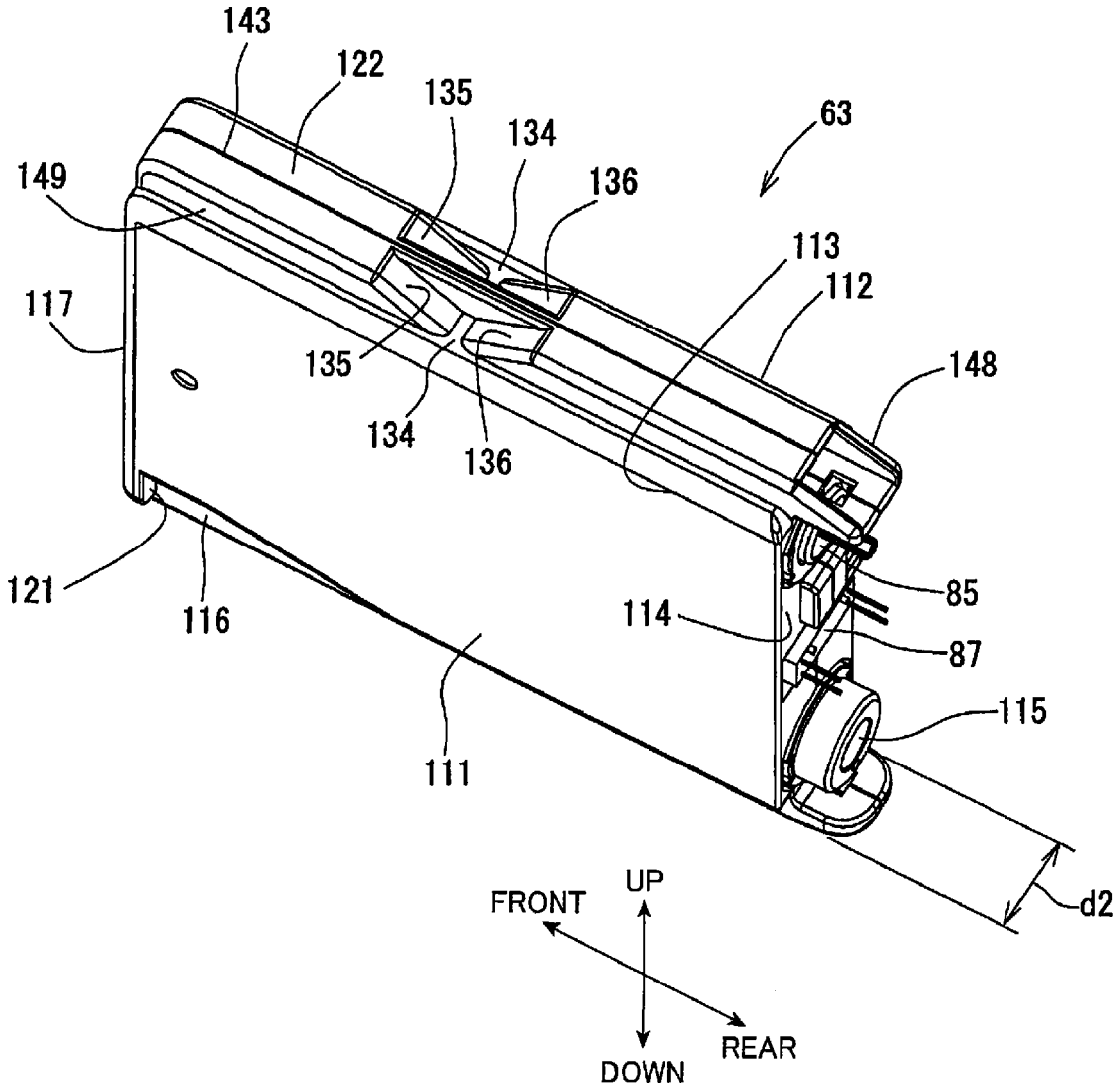
FIG. 14 is a perspective view showing the ink cartridge.

Engaging grooves 116 are provided in the bottom surface of the cartridge main body 111. As shown in FIG. 14, the engaging grooves 116 are recesses extending along the corners of the lateral surface and the bottom surface. As shown in FIG. 14, the engaging grooves 116 extend in the longitudinal direction of the cartridge main body 111. The engaging grooves 116 are provided symmetrically at the left and right lateral sides of the cartridge main body 111 (see FIG. 5). The engaging grooves 116 are open at the rear surface 114 of the cartridge main body 111.

Figure 13:
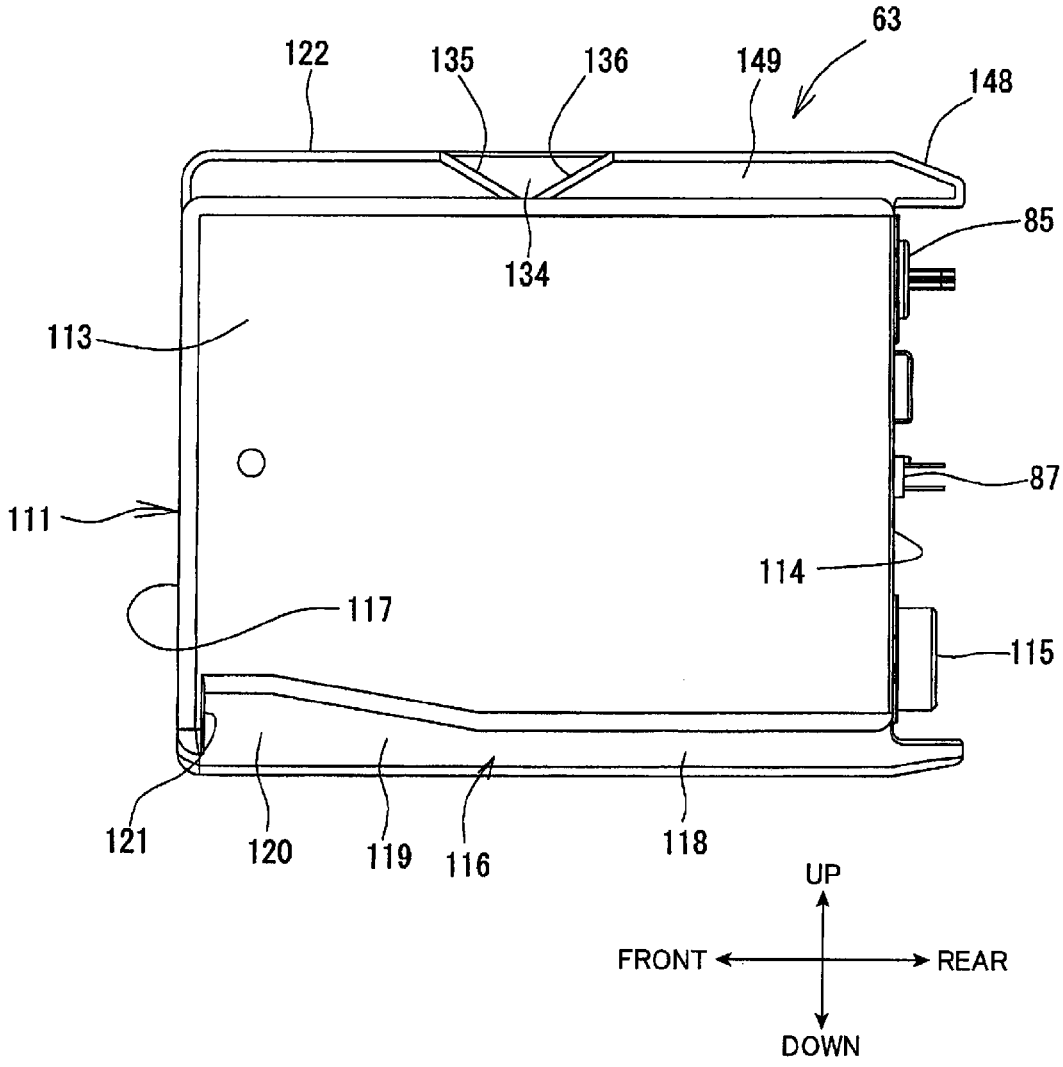
FIG. 13 is a side view showing an ink cartridge.

As shown in FIG. 13, Each engaging groove 116 includes a shallow groove 118 extending from the rear surface 114 to the front surface 117, a boundary groove 119 extending from the shallow groove 118 with a gradually increasing depth, and a deep groove 120 extending from the boundary groove 119. The deep groove 120 is not open to the front surface 117. Thus, end facet 121 is formed on the front surface 117 side of the deep groove section 120. In other words, the engaging grooves 116, 116 extend in the loading and unloading direction of the ink cartridge 63, and is open to the rear surface 114 of the cartridge main body 111. The engaging grooves 116, 116 are closed by the front surface 117 to provide the end facet 121. The bent section 97 of the guiding member 77 abut the end facet 121.

Grooves 149 are formed in the top surface 122 of the cartridge main body 111. The grooves 149 are formed as recesses extending along the corners of the lateral surface and the top surface of the cartridge main body 111, as shown in FIG. 14. The groove 149 extends in the longitudinal direction of the cartridge main body 111 and communicate with the front surface 117 and the rear surface 114. Additionally, recesses 134 are provided in the top surface 122. The recess 134 has a V-shape. Each recess 134 has a front inclined surface 135 and a rear inclined surface 136.

When the ink cartridge 63 is inserted in the casing 75, an upper rear end 148 of the cartridge main body 11 abuts the second arm 126, as shown in FIG. 7. As the ink cartridge 63 is further pushed into the casing 75, the swing arm 123 pivots counterclockwise to be positioned, take the posture as indicated by solid lines in FIG. 7. Then, when the ink cartridge 63 is further moved in, the swing arm 123 pivots clockwise as the swing arm 123 is guided by the rear inclined surfaces 136, and then is positioned in the recesses 134. When the ink cartridge 63 is loaded in the casing 75, the second arm 126 is guided by the front side inclined surfaces 135 so that the second arm 126 pivots counterclockwise again to take the posture indicated by solid lines in FIG. 7. Additionally, as the ink cartridge 63 is inserted into the casing 75, the ink cartridge 63 slides with respect to the swing arm 123 to be located at a rightward position by a predetermined distance from the position indicated by the solid lines in FIG. 7. Then, the ink cartridge 63 is completely accommodated in the casing 75. The predetermined distance is shown as a distance L1 in FIG. 8.

Figure 15A:
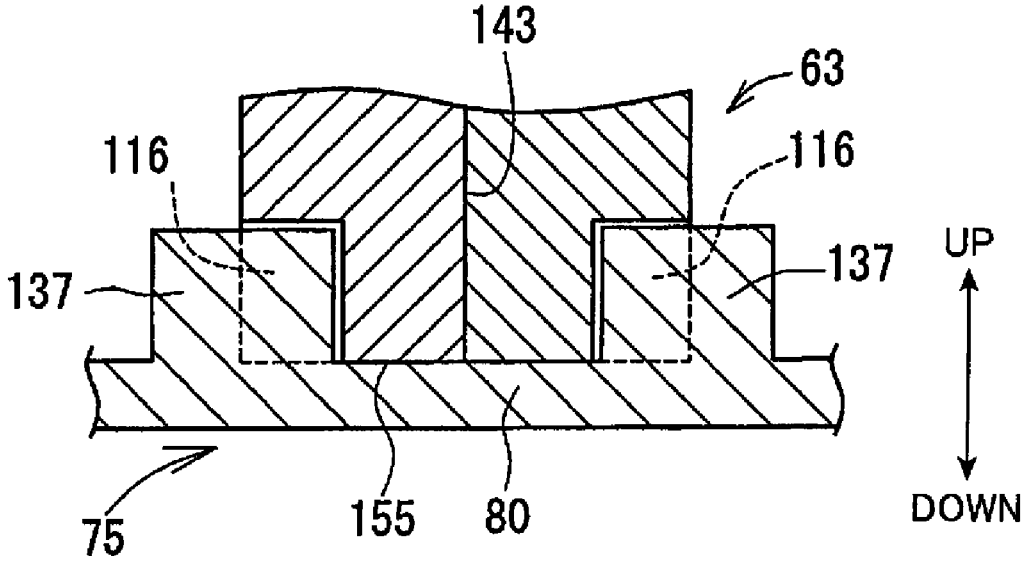
FIGS. 15A and 15B are cross sectional views illustrating an engaging structure of the ink cartridge, a casing, and guiding members of a door.
Figure 15B:
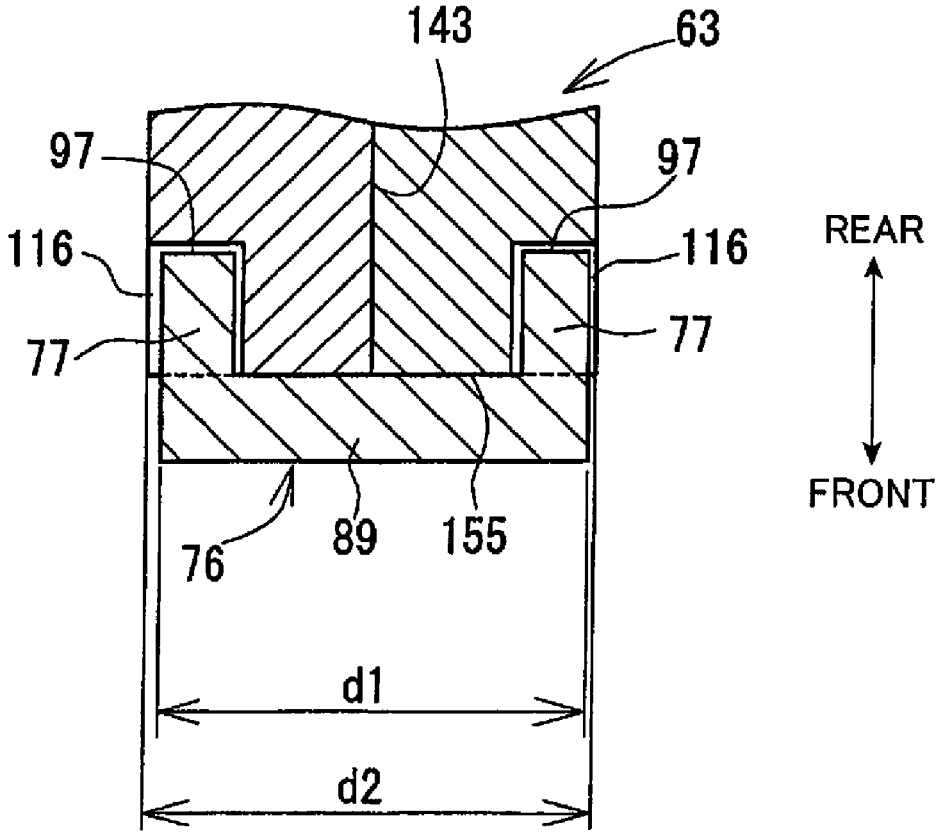

As shown in FIG. 15A, when the ink cartridge 63 is loaded in the casing 75, the partition wall section 137 in the casing 75 is engaged with the engaging groove 116 of the ink cartridge 63. At the same time, the partition wall section 137 is also engaged in the groove 149 provided in top surface 122 of the ink cartridge 63. At this time, the bottom surface 155 of the ink cartridge 63 is placed on the bottom plate 80. Accordingly, the ink cartridge 63 is positioned and accommodated in position in the casing 75 (see FIG. 6). Additionally, when the ink cartridge 63 is in the casing 75, the bottom surface 155 of the ink cartridge 63 is placed on the door main body 89, as shown in FIG. 15B. The bent section 97 of the guiding member 77 moves into the engaging groove 116. When the door 76 is opened from this state, the guiding members 77 pivot as shown in FIGS. 6 and 7, and the bent section 97 presses the end facets 121 of the engaging grooves 116 forward (leftward in FIG. 7).

Note, however, that the engaging structures of the ink cartridge 63, the casing 75, and the guiding member 77 are not limited to the above-described ones.

Figure 16A:
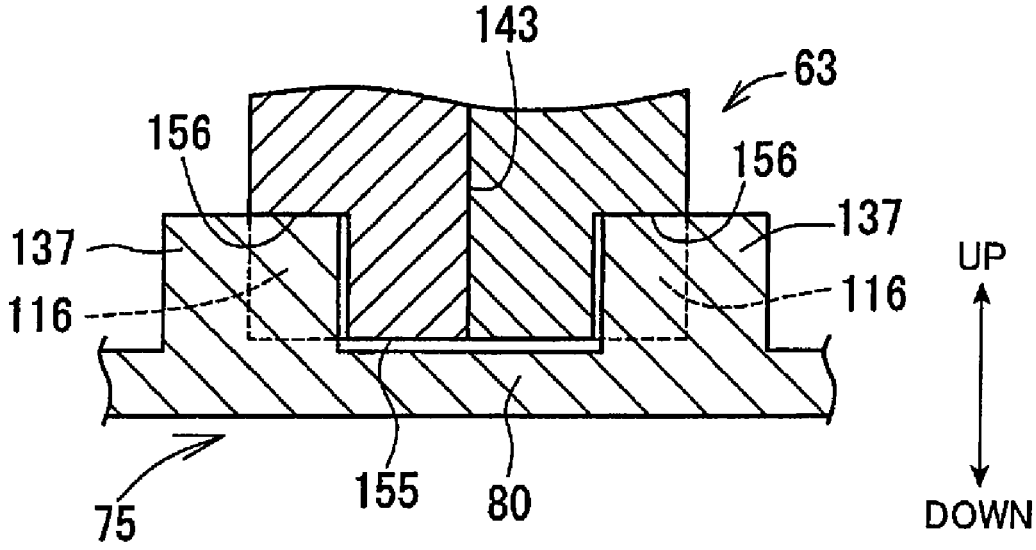
FIGS. 16A and 16B are cross sectional views illustrating another structure of the ink cartridge, a casing, and the guiding members.
Figure 16B:
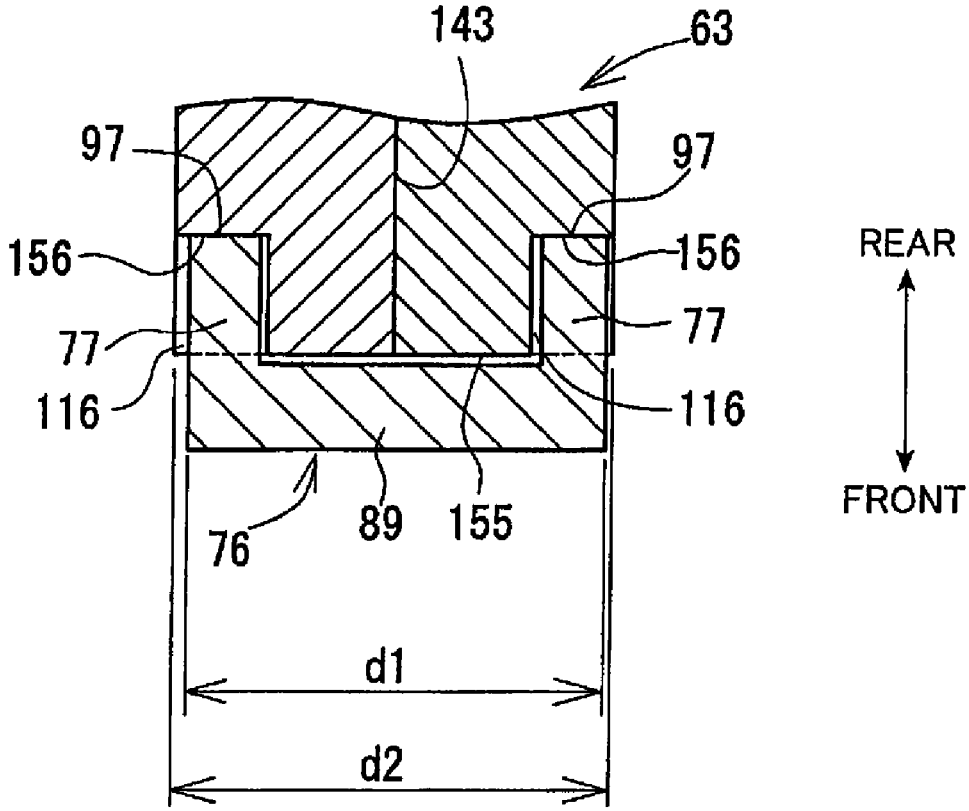

In FIGS. 15A and 15B, when the ink cartridge 63 is in the casing 75, the bottom surface 155 is placed on the bottom plate section 80 (see FIG. 15A) and on the door main body 89 (see FIG. 15B). However, in FIGS. 16A and 16B, when the ink cartridge 63 is in the casing 75, the bottom surface 155 of the ink cartridge 63 does not contact the bottom plate section 80. The top wall surfaces 156 of the engaging grooves 116 abuts the respective partition wall sections 137 (see FIG. 16A). At this time, as shown in FIG. 16B, the bottom surface 155 of the ink cartridge 63 does not contact the door main body 89. The top wall surface 156 is placed on the bent sections 97 of the guiding members 77. The bent section 97 moves into the engaging groove 116. In this case, the ink cartridge 63 is positioned and held in position in the casing 75. When the door 76 is opened, the guiding members 77 pivot as shown in FIGS. 6 and 7, and the bent sections 97 presses the end facets 121 of the engaging grooves 116 forward (leftward in FIG. 7).

Figure 17A:
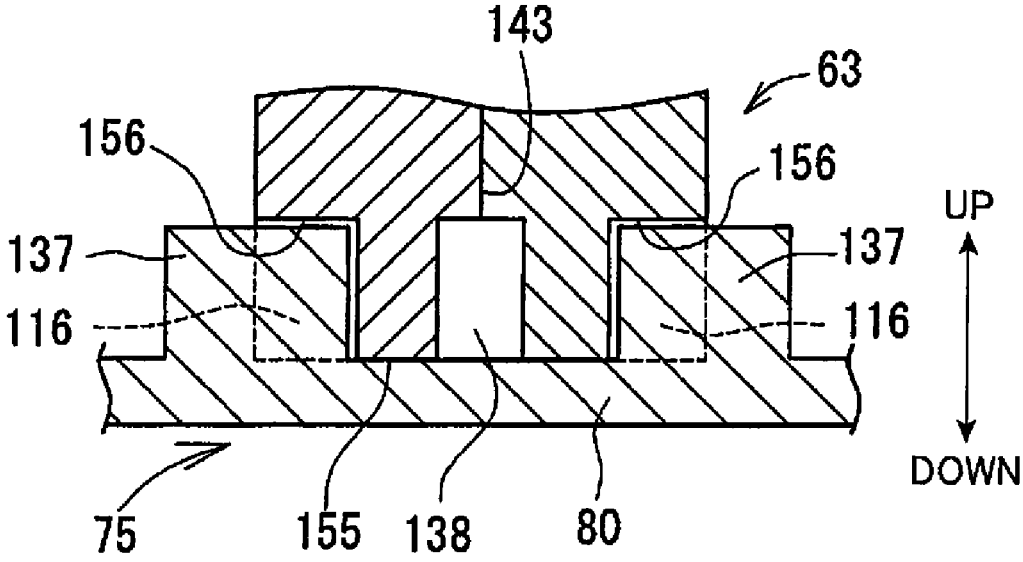
FIGS. 17A and 17B are cross sectional views illustrating a further structure of the ink cartridge, a casing, and the guiding members.
Figure 17B:
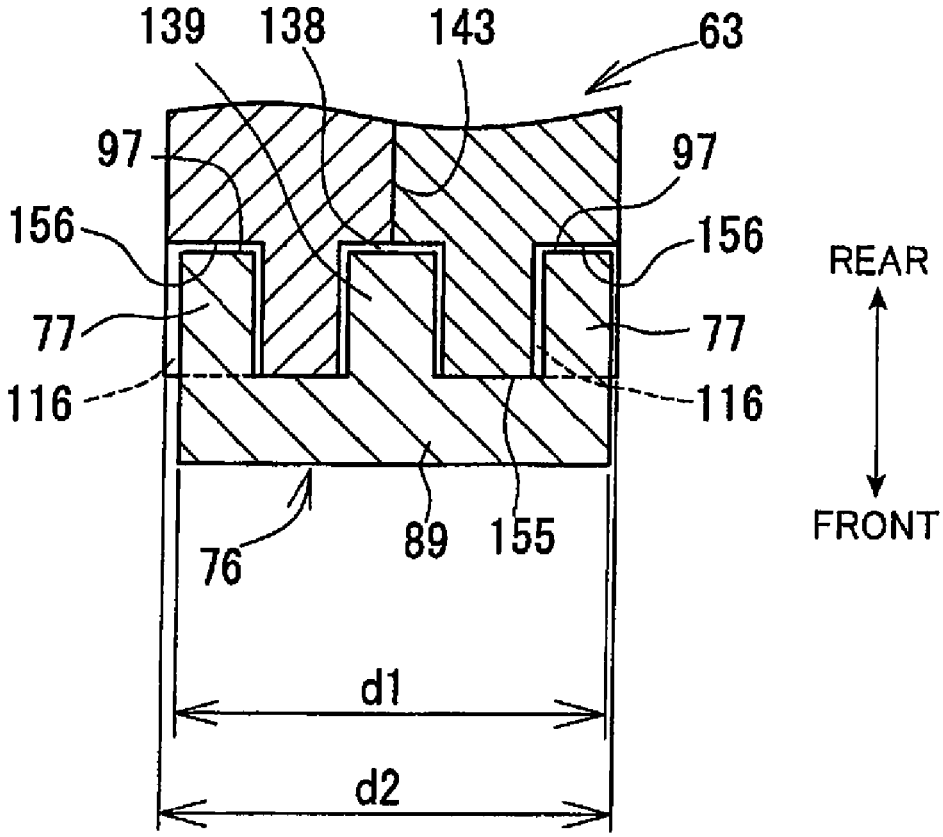

In FIGS. 17A and 17B, the ink cartridge 63 is provided with a groove 138 in the bottom surface 155. The groove 138 extends in a direction same as the longitudinal direction of the engaging grooves 116. A ridge 139 that is fitted in the groove 138 is formed in the door main body 89. The ridge 139 extends in a direction same as the longitudinal direction of the engaging grooves 116 to be fitted in the groove 138. When the ink cartridge 63 is in the casing 75, the bottom surface 155 of the ink cartridge 63 is placed on the bottom plate section 80 and on the door main body 98. The bent sections 97 of the guiding members 77 move into the engaging groove 116.

When the door 76 is opening, the guiding member 77 pivots, as shown in FIGS. 6 and 7. The bent section 97 pull presses the end facet 121 of the engaging groove 116 forward (leftward in FIG. 7). At this time, the ridge 139 of the door main body 89 becomes fitted into the groove 138 of the ink cartridge 63. Therefore, when the door 76 is opened, the ink cartridge 63 is stably pulled out from the casing 75 without laterally falling down. As a result, the operation of taking out the ink cartridge 63 is performed smoothly.

In the multifunction device 10, the used ink cartridge is replaced in the following manner.

When unloading the ink cartridge 63 from the multifunction device 10, the operator firstly opens the lid 72, as shown in FIG. 1. The refill unit 70 is then exposed at the front surface of the multifunction device 10. When the lid 72 is opened, the lock release lever 92 of the refill unit 70 changes the posture to the neutral position and is inclined to the front surface of the multifunction device 10. Therefore, the operator can very easily open the door 76 of the refill unit 70 and unload the ink cartridge 63.

The operator then opens the door 76 of the refill unit 70. More specifically, the operator pushes down the lock release lever 92 with his/her finger to displace the lock release lever 92 to the lying position. Accordingly, the lock member 91 of the door 76 slides downward and the key section 133 of the lock member 91 (see FIG. 12) is released from the lock member engaging hole 83 of the door 76. Thus, the operator can open the door 76 as shown in FIG. 1 by simply pulling the lock release lever 92.

When the door 76 is opening from the closed posture, the guiding member 77 pivots about the pivot 94, and the bent section 97 abuts the end facet 121 of the ink cartridge 63 and pushes the end facet 121 leftward in FIG. 8 (frontward in FIG. 1). Therefore, the ink cartridge 63 is unloaded by the predetermined distance L1 from the opening 88 of the casing 75. Therefore, the operator can easily take out the ink cartridge 63 from the casing 75.

Then, a new ink cartridge 63 is loaded into the containing chamber 78 through the opening 88. At this time, the door 76 is opened. The ink cartridge 63 to be loaded into the containing chamber 78 is placed on the outer wall surfaces 110, and then loaded into the containing chamber 78, being guided by the outer wall surfaces 110. Particularly, the new ink cartridge 63 is firstly placed on the ridges 141, 142 on the wall surface 84 of the press member 90 and guided on the outer wall surfaces 110 of the bent sections 97, sliding along the ridges 141, 142. After the new ink cartridge 63 is loaded in the casing 75, the operator closes the door 76. As the door 76 is closing, the press member 90 abuts the front surface 117 of the ink cartridge 63. When the door 76 is completely closed, the press member 90 resiliently urges the ink cartridge into the containing chamber 78. At the same time, the key section 133 is engaged with the lock member engaging hole 83 of the casing 75 so that the door 76 remains closed.

In this way, when the operator simply opens the door 76 of the refill unit 70, the used ink cartridge is automatically unloaded. The operator can easily load the new ink cartridge in the casing 75, while the door 76 is maintained open. Thus, the operation of replacing the ink cartridge is very simple.

As shown in FIG. 7, the top plate 82 of the casing 75 is provided with a swing arm 123. When the ink cartridge 63 is unloaded from the casing 75 by the distance L1, the swing arm 123 presses the front inclined surfaces 135. In other words, the resilient force of the extension spring 128 acts on the front inclined surfaces 135 through the swing arm 123 so that the ink cartridge 63 is resiliently urged to the opening 88. Thus, when the door 76 is opened, and the ink cartridge 63 is unloaded from the opening 88 by the guiding members 77, the swing arm 123 pivots clockwise in FIG. 7 to press the front inclined surface 135 to the opening 88. Accordingly, the swing arm 123 moves into the recess 134, and the second arm 126 of the swing arm 126 contacts the rear inclined surfaces 136. In other words, the swing arm 123 remains in the recesses 134.

As the swing arm 123 pivots and moves into the recesses 134, the ink cartridge 63 is further pressed out from the casing 75 by the distance L2. Thus, the ink cartridge 63 is unloaded from the opening 88 by the distance (L1+L2), so that the operator can easily grasp the used ink cartridge 63 and unload the ink cartridge 63 from the casing 75 easier.

Due to the pair of guiding members 77, the ink cartridge 63 is supported and held in the containing chamber 78 (see FIG. 15). Thus, the ink cartridge 63 is loaded from the opening 88 by means of the guiding members 77. Additionally, as shown in FIGS. 7 and 8, the bent section 97 of the guiding members 77 is placed substantially horizontal so as to extend from the mounting surface 98. Thus, when a new ink cartridge is loaded into the containing chamber 78 through the opening 88, the new ink cartridge is reliably supported by the guiding members 77 merely by placing the new ink cartridge on the outer wall sections 110 of the bent sections 97. And the new ink cartridge is guided on the mounting surface 98. Therefore, the operator can perform the operation of replacing the ink cartridge so much easier.

Additionally, the guiding member 77 is engaged in the engaging groove 116 formed in the ink cartridge 63. Since the distance d1 between the paired guiding members 77 (see FIG. 9) is formed smaller than the width d2 of the ink cartridge 63 (see FIG. 14), the guiding members 77 do not project over the ink cartridge 63. As the distance d1 is smaller than the width d2, the door 76 can be designed compact. Consequently the refill unit 70 and the multifunction device 10 can be downsized.

Particularly, the refill unit 70 is placed near the front surface 71 of the multifunction device 10. The operator can load and unload the ink cartridge 63 with respect to the containing chamber through the front surface of the refill unit 70, which leads in a simple replacement of the ink cartridge 63. Additionally, as shown in FIG. 8, when the door 76 is opening, the bent sections 97 of the guiding members 77 pivot to press the end facets 121 of the ink cartridge 63, so that the ink cartridge 63 is unloaded from the casing 75. The bent section 97 has another function as a member for guiding the new ink cartridge to the casing 75. Thus, the guiding member 77 has a very simple structure, thereby minimizing the cost of manufacturing the refill unit 70.

According to the present invention, the ink cartridge is unloaded from the casing by the guiding members, when the door is opening. Therefore, the operation of taking out the ink cartridge from the casing is simple. Additionally, when the door is open, a new ink cartridge is guided by the guiding members and loaded into the casing. Therefore, the operation of loading the new ink cartridge is also simple. In other words, the ink cartridge is automatically unloaded, as the operator merely opens the door. And, the operator can insert the ink cartridge into the casing with ease by placing the ink cartridge on the door of the refill unit, when the door is open. Thus, the operation of replacing the ink cartridge becomes simple.

While the invention has been described in detail with reference to the above aspects thereof, it would be apparent to those skilled in the art that various changes and modifications may be made therein without departing from the spirit of the invention.

What is claimed is:

1. An ink cartridge loading device, comprising:

a casing having a chamber that accommodates an ink cartridge, and a side face having an opening communicated with the chamber for loading and unloading the ink cartridge therethrough, the opening having a lower end and the chamber having a mounting surface for mounting the ink cartridge thereon;

a door having a lower end which is pivotable about the lower end of the opening, the door being movable between a first position and a second position, the door closing the opening at the first position, the door opening the opening at the second position; and a pair of guiding members, each of the pair of guiding members is attached and fixed to the lower end of the door to sandwich the ink cartridge therebetween in a horizontal direction when the ink cartridge is in the chamber, each of the pair of guiding members having an L-shaped profile and comprising an extended portion and a bent section extending from the extended portion, the bent section having a guide surface disposed substantially on an extending line extending from the mounting surface of the chamber in an ink cartridge unloading direction when the door is at the second position, the pair of guiding member partially guiding the ink cartridge from the chamber through the opening to outside contact with at least one guide ridge of the door when the door moves from the first position to the second position, the pair of guiding members supporting the ink cartridge positioned on the guide surface of the door when the door is at the second position, and the pair of guiding members guiding the ink cartridge on the guide surface from contact with the at least one guide ridge of the door into the chamber when the door moves from the second position to the first position, wherein the pair of guiding members are configured to engage engaging portions provided in the ink cartridge, respectively.

2. The ink cartridge loading device according to claim 1, wherein each of the engaging portions is a groove.

3. The ink cartridge loading device according to claim 1, wherein the door has a main surface configured to oppose the ink cartridge in the chamber, the extended portion extends from the one end in a direction of a normal to the main surface, and the bent section extends from the extended portion away from the main surface.

4. The ink cartridge loading device according to claim 1, wherein a distance between the pair of guiding members is less than a maximum length of the ink cartridge in the horizontal direction in which the ink cartridge is sandwiched between the pair of guiding members.

5. An ink cartridge unit, comprising:

an ink cartridge; and an ink cartridge loading device that accommodates the ink cartridge therein, wherein the ink cartridge loading device comprises:

a casing having a chamber that accommodates an ink cartridge, and a side face having an opening communicated with the chamber for loading and unloading the ink cartridge therethrough, the opening having a lower end and the chamber having a mounting surface for mounting the ink cartridge thereon;

a door having a lower end which is pivotable about the lower end of the opening, the door being movable between a first position and a second position, the door closing the opening at the first position, the door opening the opening at the second position; and a pair of guiding members, each of the pair of guiding members is attached and fixed to the lower end of the door to sandwich the ink cartridge therebetween in a horizontal direction when the ink cartridge is in the chamber, each of the pair of guiding members having an L-shaped profile and comprising an extended portion and a bent section extending from the extended portion, the bent section having a guide surface disposed substantially on an extending line extending from the mounting surface of the chamber in an ink cartridge unloading direction when the door is at the second position, the pair of guiding member partially guiding the ink cartridge from the chamber through the opening to outside contact with at least one guide ridge of the door when the door moves from the first position to the second position, the pair of guiding members supporting the ink cartridge positioned on the guide surface of the door when the door is at the second position, and the pair of guiding members guiding the ink cartridge on the guide surface from contact with the at least one guide ridge of the door into the chamber when the door moves from the second position to the first position, wherein the pair of guiding members are configured to engage engaging portions provided in the ink cartridge, respectively.

6. The ink cartridge unit according to claim 5, wherein the engaging portion is a groove.

7. The ink cartridge unit according to claim 5, wherein the door has a main surface configured to oppose the ink cartridge in the chamber, the extended portion extends from the one end in a direction of a normal to the main surface, and the bent section extends from the extended portion away from the main surface.

8. The ink cartridge unit according to claim 5, wherein a distance between the pair of guiding members is less than a maximum length of the ink cartridge in the horizontal direction in which the ink cartridge is sandwiched between the pair of guiding members.

9. An ink cartridge loadable in an ink cartridge loading device comprising:

a casing having a chamber that accommodates an ink cartridge, and an opening communicated with the chamber for loading and unloading the ink cartridge therethrough, the opening having a lower end and the chamber having a mounting surface for mounting the ink cartridge thereon;

a door having a lower end which is pivotable about the lower end of the opening, the door being movable between a first position and a second position, the door closing the opening at the first position, the door opening the opening at the second position; and a pair of guiding members, each of the pair of guiding members is attached and fixed to the lower end of the door to sandwich the ink cartridge therebetween in a horizontal direction when the ink cartridge is in the chamber, each of the pair of guiding members having an L-shaped profile and comprising an extended portion and a bent section extending from the extended portion, the bent section having a guide surface disposed substantially on an extending line extending from the mounting surface of the chamber in an ink cartridge unloading direction when the door is at the second position, the pair of guiding member partially guiding the ink cartridge from the chamber through the opening to outside contact with at least one guide ridge of the door when the door moves from the first position to the second position, the pair of guiding members supporting the ink cartridge positioned on the guide surface of the door when the door is at the second position, and the pair of guiding members guiding the ink cartridge on the guide surface from contact with the at least one guide ridge of the door into the chamber when the door moves from the second position to the first position, the ink cartridge comprising: a main unit that contains ink, wherein the main unit having an engaging portion that receives the pair of guiding members when the door is at the second position.

10. The ink cartridge according to claim 9, wherein a distance between the pair of guiding members is less than a maximum length of the ink cartridge in the horizontal direction in which the ink cartridge is sandwiched between the pair of guiding members.

* * * * *